US008845192B1

(12) United States Patent
Bayliss

(10) Patent No.: US 8,845,192 B1
(45) Date of Patent: Sep. 30, 2014

(54) RIGID RECLOSURE ON FLEXIBLE PACKAGING

(71) Applicant: Robert Bayliss, Pymble (AU)

(72) Inventor: Robert Bayliss, Pymble (AU)

( * ) Notice: Subject to any disclaimer, the term of this patent is extended or adjusted under 35 U.S.C. 154(b) by 0 days.

(21) Appl. No.: 13/647,014

(22) Filed: Oct. 8, 2012

(51) Int. Cl.

| | |
|---|---|
| ***B65D 33/00*** | (2006.01) |
| ***B65D 33/16*** | (2006.01) |
| ***B65D 41/56*** | (2006.01) |
| ***B65D 1/40*** | (2006.01) |

(52) U.S. Cl.
USPC ..... 383/95; 383/66; 383/80; 220/212; 220/735

(58) Field of Classification Search
USPC ..... 383/80, 96, 66, 95; 220/697, 574.1, 220/212, 735; 206/553, 541
See application file for complete search history.

(56) References Cited

U.S. PATENT DOCUMENTS

| | | | | |
|---|---|---|---|---|
| 3,575,225 | A * | 4/1971 | Muheim | 383/206 |
| 4,185,754 | A * | 1/1980 | Julius | 221/63 |
| 4,834,255 | A | 5/1989 | Boots | 229/41 |
| 5,407,090 | A | 4/1995 | Boots | 220/470 |
| 5,860,742 | A * | 1/1999 | Faircloth, Jr. | 383/80 |
| 6,240,709 | B1 | 6/2001 | Cook | 53/469 |
| 6,702,109 | B1 * | 3/2004 | Tabuchi | 206/233 |
| 7,025,220 | B2 * | 4/2006 | Verespej et al. | 220/259.1 |
| 7,546,930 | B2 * | 6/2009 | Banik et al. | 220/254.3 |
| 7,665,629 | B2 * | 2/2010 | Julius et al. | 221/63 |
| 7,971,747 | B2 * | 7/2011 | Blomdahl et al. | 220/735 |
| 8,302,805 | B2 * | 11/2012 | Blomdahl et al. | 220/735 |
| 2005/0207680 | A1 * | 9/2005 | Schumacher et al. | 383/66 |

* cited by examiner

*Primary Examiner* — Jes F Pascua
(74) *Attorney, Agent, or Firm* — Keisling & Pieper PLC; David B. Pieper

(57) ABSTRACT

The rigid reclosure device allows reclosing a flexible packaging of packaged goods (dry, granular, powder or liquid products). A lid with neck contacts a base and shoulder to seal the packaging to limit the removal of the contents from the packaging. The base fixedly attaches to the packaging, which may be a flexible packaging, to seal the packaging when the lid is in the closed position. Retention fingers of the lid and the base engage each other to secure the lid in the closed position. An access tab provides access to the lid to allow the user to open the sealing head to gain access to the contents of the packaging. The access tab may provide a child resistant design depending upon the contents of the packaging. A scoop may also be stored on the lid.

10 Claims, 43 Drawing Sheets

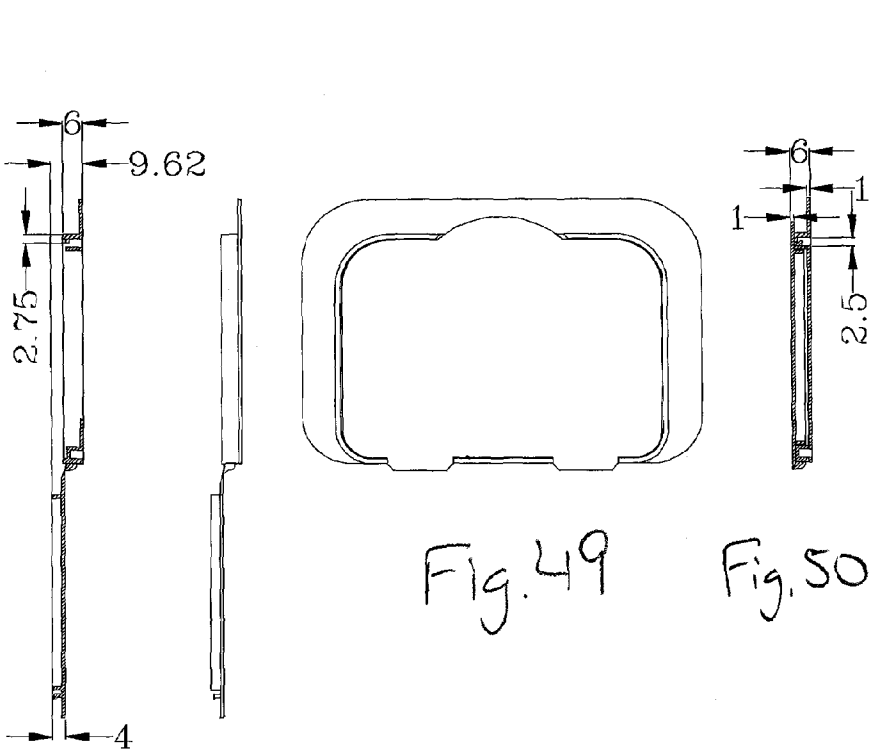
Fig. 47
Fig. 48
Fig. 49
Fig. 50
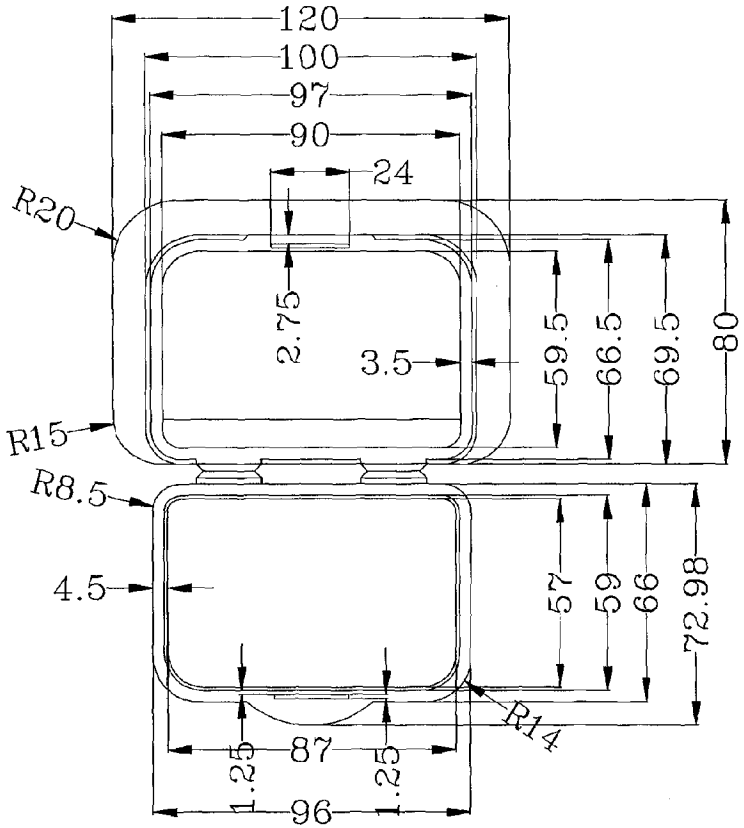
Fig. 46

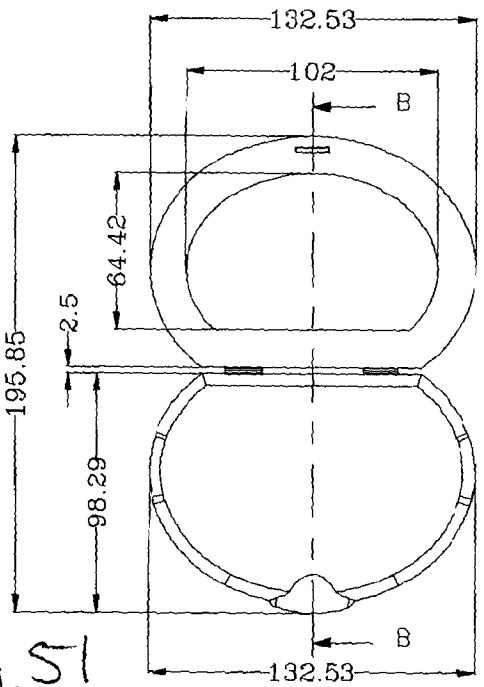
Fig. 51
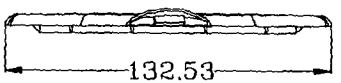
Fig. 52
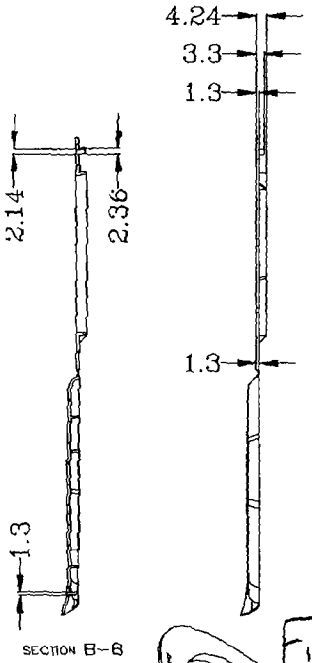
Fig. 53
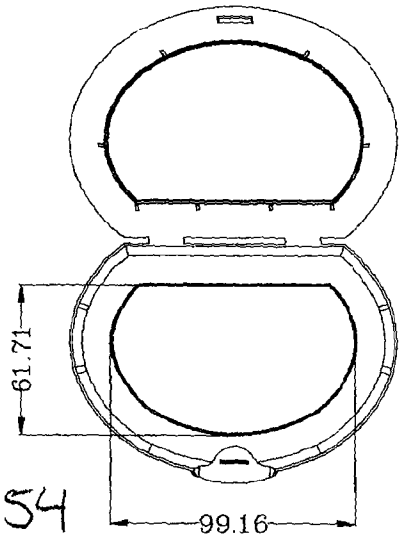
Fig. 54
Fig. 55
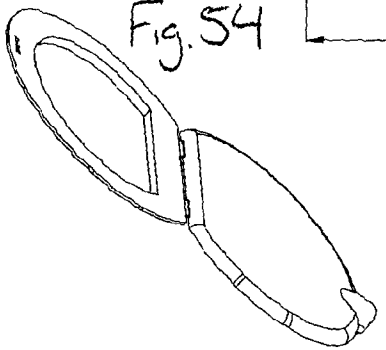
Fig. 56

RIGID RECLOSURE ON FLEXIBLE PACKAGING

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates to a reclosure mechanism used on packaging to contain free flowing materials, powders, pellets, liquids and the like. The packaging of the present invention is primarily constructed from polyolefin derived materials (polyethylene, nylon, polypropylene, EVOH, PET etc) but may include cellulose derived materials including but not limited to cellophane, kraft paper, etc. The packaging of the present invention typically includes lay flat bags, standup pouches, stackable bags including but not limited to the U-Pack or Gambo pack.

The present invention relates to the art of making bags reclosable. The present invention is capable of storing products including flowable products but not limited to dry products such as grass seed, cat litter, pet food, powders, nuts, spices, flowable matter, etc. Packaging of various types such as layflat bags, standup pouches, U-Pack's, Gambo style bags typically do not have any reclosure features beyond zippers (press to close or slider zippers) or stick down sticky tapes. Such packaging suffers due to the difficulty in resealing such reclosure features. One of the disadvantages of these packages is that once the package has been opened for dispensing part of the contents, resealing the package to retain freshness, taste and for retaining the contents against spillage is difficult and at least haphazard. Many of the reclosure devices also become fouled or clogged with the contents within the package which in turn renders the reclosure ineffective.

II. Description of the Known Art

The rigid reclosure on flexible packaging of the present invention is especially adapted for resealing packaging. The present invention provides easier access and easier ability to reclose the packaging. The simplified reclosure of the present invention preserves freshness of the contents and allows for the user to close the packaging to prevent spillage. The present invention also provides a more compact design that increases the user's ability to stack the packaging. The present invention overcomes many of the disadvantages of the known art. Therefore, the present invention is needed to provide a simpler reclosure system.

SUMMARY OF THE INVENTION

The present invention relates to a reclosure body that is secured to flexible packaging by adhesive and/or heat sealed directly onto the packaging. The reclosure body allows for improved sealing of known packaging. The reclosure body includes a sealing head and a sealing base and/or a sealing body. The sealing head snaps into a sealing base to secure the reclosure body into the closed position. In one embodiment, the sealing head attaches to the sealing body and/or sealing base. The sealing head may be attached by hinges at the rear of the sealing body and/or sealing base. The front of the reclosure body can be shaped to facilitate pouring of the contents. One embodiment of the present invention provides a child resistant reclosure body that limits access to the contents of the packaging. One embodiment of the present invention also incorporates a scoop that is housed either on the outside or the inside of the sealing head.

Typically, a protrusion such as an opening finger in the front of the lid will provide access for lifting the lid open. Clips are built into the lid and base to enable the lid to be snapped closed to prevent the lid from freely opening.

However, in the packaging of hazardous or toxic chemicals or particularly expensive compounds, it may be desirable to provide a child resistant or difficult to open feature requiring a flat tool including but not limited to a coin, screw driver, flat head, knife, flat surface, etc. to pry the lid open. Such packaging does not have an opening finger that extends from the lid. Therefore, the user must use a flat tool to open the lid. Other child resistant mechanisms may include the requirement of aligning two opposing sliders with the lid and the base before the lid will readily open.

The packaging may be perforated within the interior of the sealing base so that the packaging can be readily opened without the use of utensils. In other embodiments, the user may be required to puncture the packaging to gain access to the contents.

It is an object of the present invention to provide an improved method of storing contents within packaging.

It is another object of the present invention to reduce the costs and resources required to maintain the contents held within the packaging.

It is another object of the present invention to improve a reclosure system to improve a user's ability to reseal the packaging.

It is another object of the present invention to prevent children from opening the packaging.

It is another object of the present invention to provide a scoop stored on the lid of the present invention to improve a user's ability to dispense the contents of the packaging.

It is another object of the present invention to provide a spout placed on the lid to allow a user to pour the contents of the packaging with improved accuracy.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 6 is side isometric view thereof;

FIG. 29 is a rear view thereof;

FIG. 46 is a top view of one embodiment of the present invention;

FIG. 47 is a cutaway view thereof;

FIG. 48 is a left side view thereof; the right side view being a mirror image of the left side view;

FIG. 49 is a top view thereof;

FIG. 50 is a cutaway view thereof;

FIG. 51 is a top view of one embodiment of the present invention;

FIG. 52 is a front view thereof;

FIG. 53 is a cutaway view thereof;

FIG. 54 is a left side view thereof; the right side view being a mirror of the left side view;

FIG. 55 is a top view thereof;

FIG. 56 is a bottom perspective view thereof;

DETAILED DESCRIPTION

Figure 1:
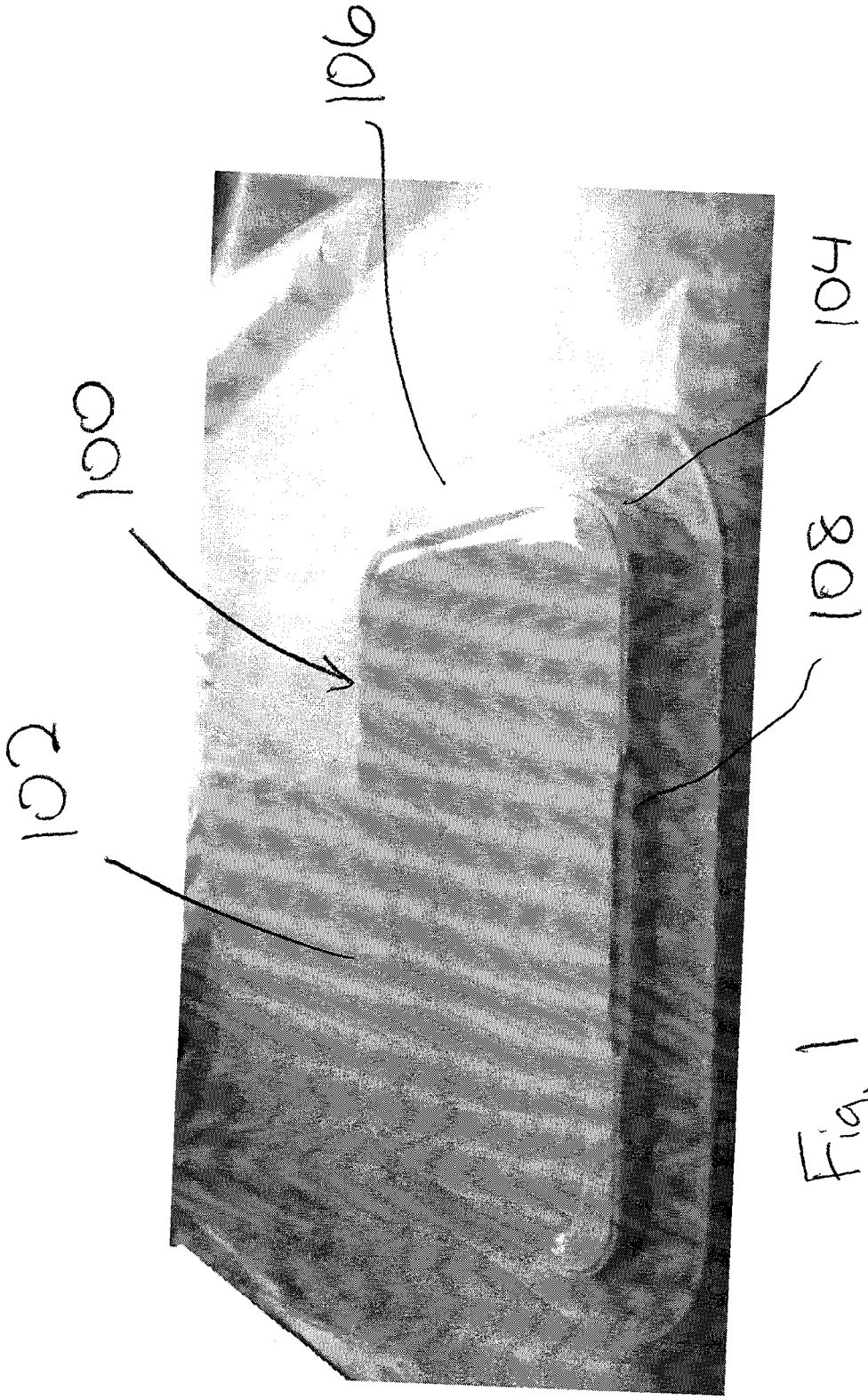
FIG. 1 is an isometric view of one embodiment of the present invention.

FIGS. 1-6 show one embodiment of the present invention generally shown as 100. The reclosure body 100 may be constructed from materials such as a rigid plastic or polyolefins such as polypropylene, polyethylene (both high density, low density, linear low density), nylon, PET, EVOH, composites of paper fibers and plastics etc. Sealing head 102 attaches to a sealing shoulder 104. In one embodiment, sealing head 102 may be completely removed from sealing shoulder 104 to allow unobstructed access to the contents of the packaging. Sealing head, of such an embodiment, is a separate piece that is not fixedly attached to the sealing base.

In another embodiment, shown in FIGS. 1-6, sealing head 102 is pivotally attached to sealing shoulder 104 to prevent a user from accidentally misplacing or losing the sealing head 102. Sealing head 102 contacts sealing shoulder 104 to seal the packaging. Sealing head 102 engages a portion of sealing shoulder 104 to create the seal to prevent air, debris, or other contaminants entering the packaging.

Sealing base 106 fixedly attaches to the packaging 120, which may be a flexible packaging. Sealing base 106 provides a seal with the packaging. In one embodiment, the packaging 120 is a film. The sealing base 106 is heat sealed to the packaging 120. The packaging is melted onto the sealing base 106 by a hot bar, impulse, ultrasonic, or other sealing device. In one embodiment, sealing base 106 is attached to the packaging by an adhesive. A hot melt adhesive is sprayed via a heated gun onto the sealing base 106. The sealing base is then pressed onto the packaging while the glue is still hot. The sealing base 106 may be attached to the packaging via other adhesives.

The seal of sealing base 106 with packaging 120 allows sealing head 102 to create a seal when sealing head 102 engages sealing shoulder 104. The seal created by sealing head 102 and sealing base 106 may create an air tight seal if needed. Otherwise, the seal may provide a closure that limits and/or prevents the contents from being removed from the packaging. Sealing head 102 may snap into place into the sealing shoulder 104 or sealing base 106 to secure the sealing head 102 in the closed position. In one embodiment, sealing shoulder 104 extends upwards from sealing base 106. The extension of sealing shoulder 104 above sealing base 106 provides space for sealing head 102 to contact sealing shoulder 104 to create the seal.

The extension of sealing shoulder 104 above sealing base 106 also provides the user with adequate space to allow the user to manipulate access tab 108. The embodiment of the invention shown in FIGS. 1-6 demonstrates the use of the secure access tab 108 that prevents children from accessing the contents of the packaging. Access tab 108 does not extend outwards from sealing shoulder 104. Instead, access tab 108 extends toward the interior such that no extension of access tab 108 protrudes outwards from sealing shoulder 104. A user must insert a tool between sealing head 102 and sealing shoulder 104 to open sealing head 102. In order for a user to manipulate such an access tab 108, the user must use a flat edge, such as a coin, a screwdriver, or some other flat head that can extend into access tab 108 to open sealing head 102. To open access tab 108, a user must insert the flat edge into the aperture at access tab 108 such that the flat edge is inserted between sealing head 102 and sealing shoulder 104. The user may then lift sealing head 102 to gain access to access aperture 118 as shown in FIG. 3.

The user dispenses the contents of the reclosure body 100 through the access aperture. The access aperture of the present invention is large enough to allow a user to gain easy access to the contents. Because one embodiment of the present invention provides a scoop, the access aperture of one embodiment is sized to allow a user to insert the scoop and his hand into the access aperture. The access aperture can range from 4.5 to 8.5 inches by 6.5 to 10.5 inches or 6 to 10 inches by 10 to 14 inches.

Figure 2:
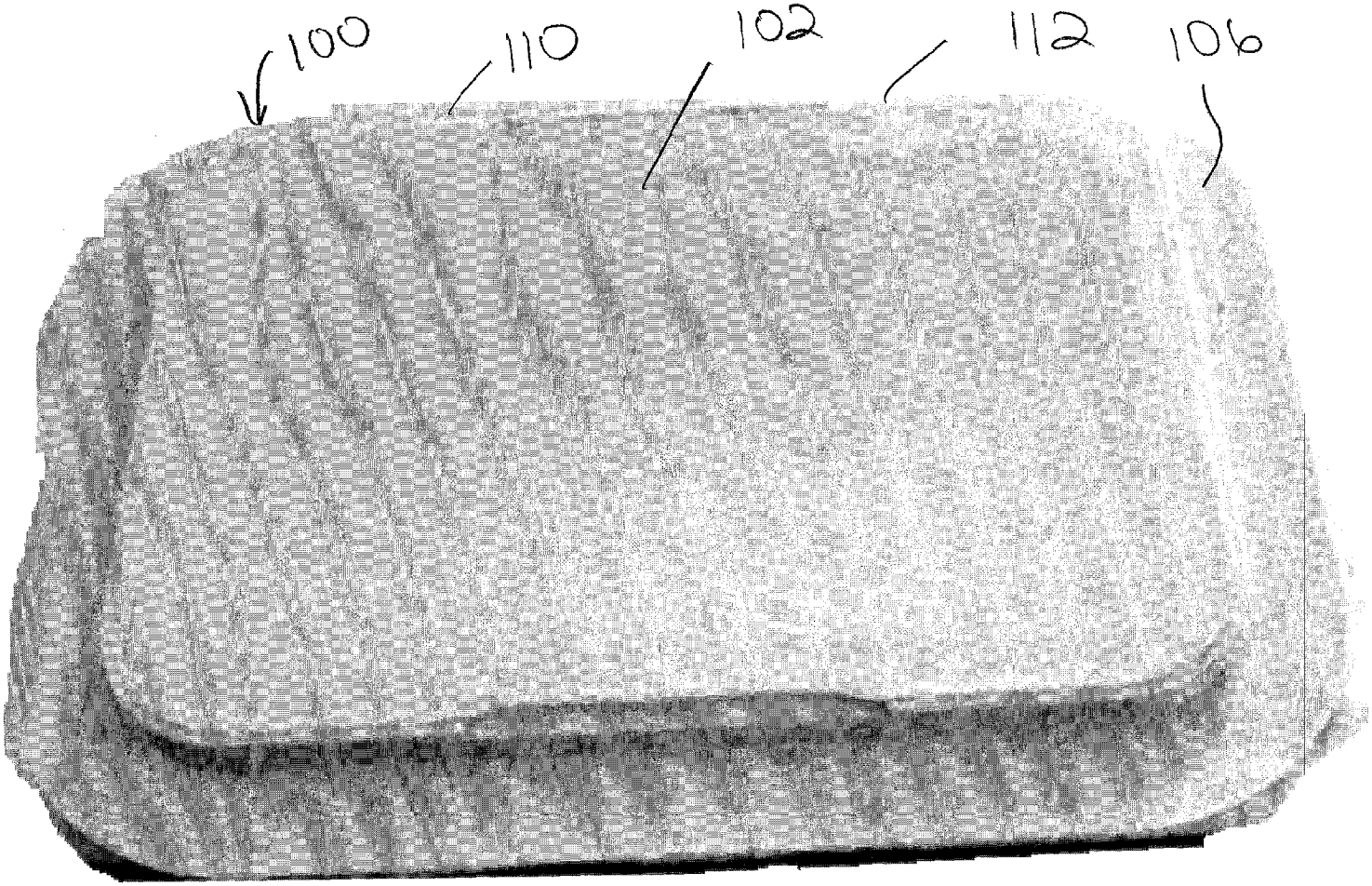
FIG. 2 is a top view thereof.
Figure 4:
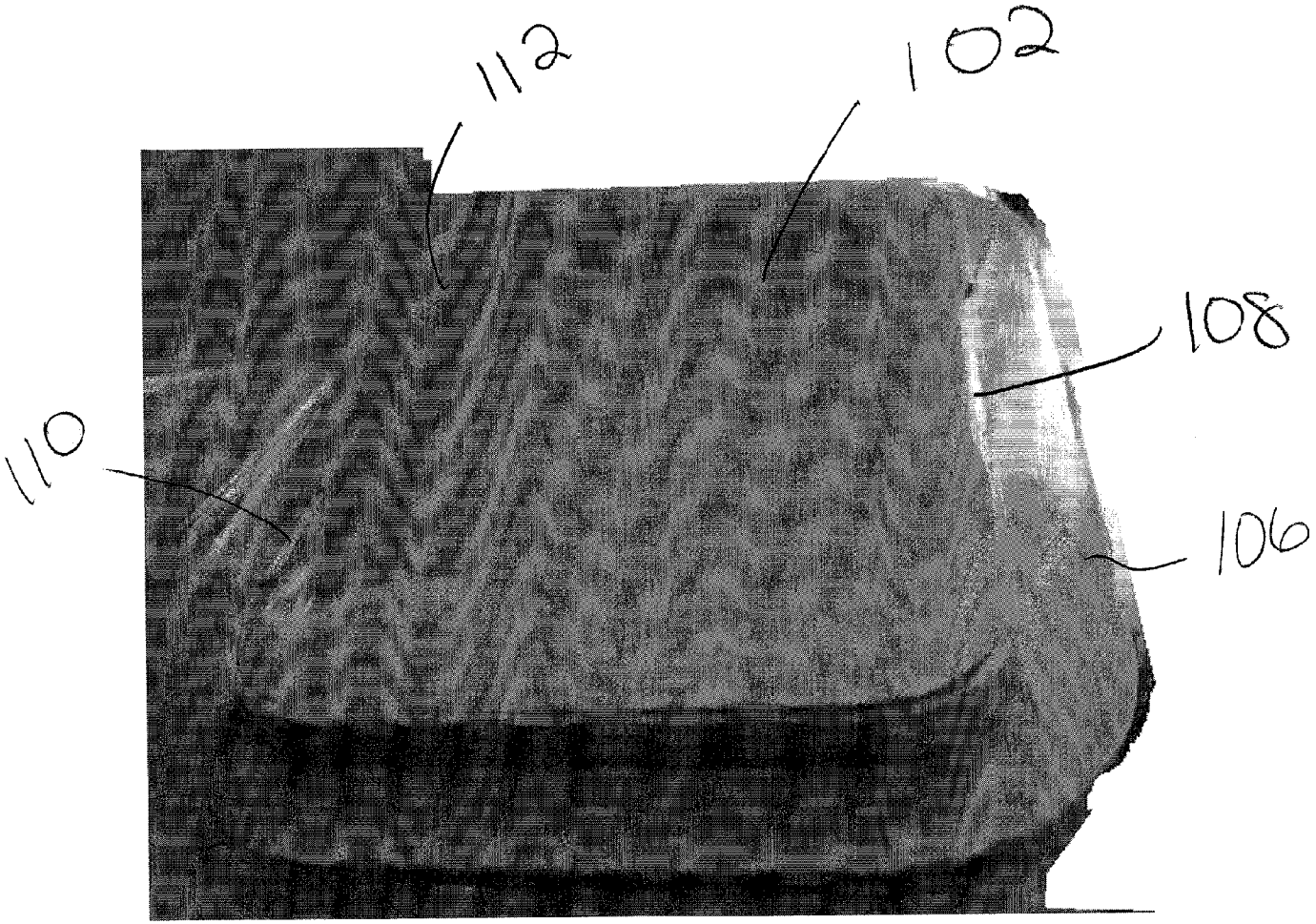
FIG. 4 is a right side view thereof, the left side view being a mirror image of the right side view.
Figure 5:
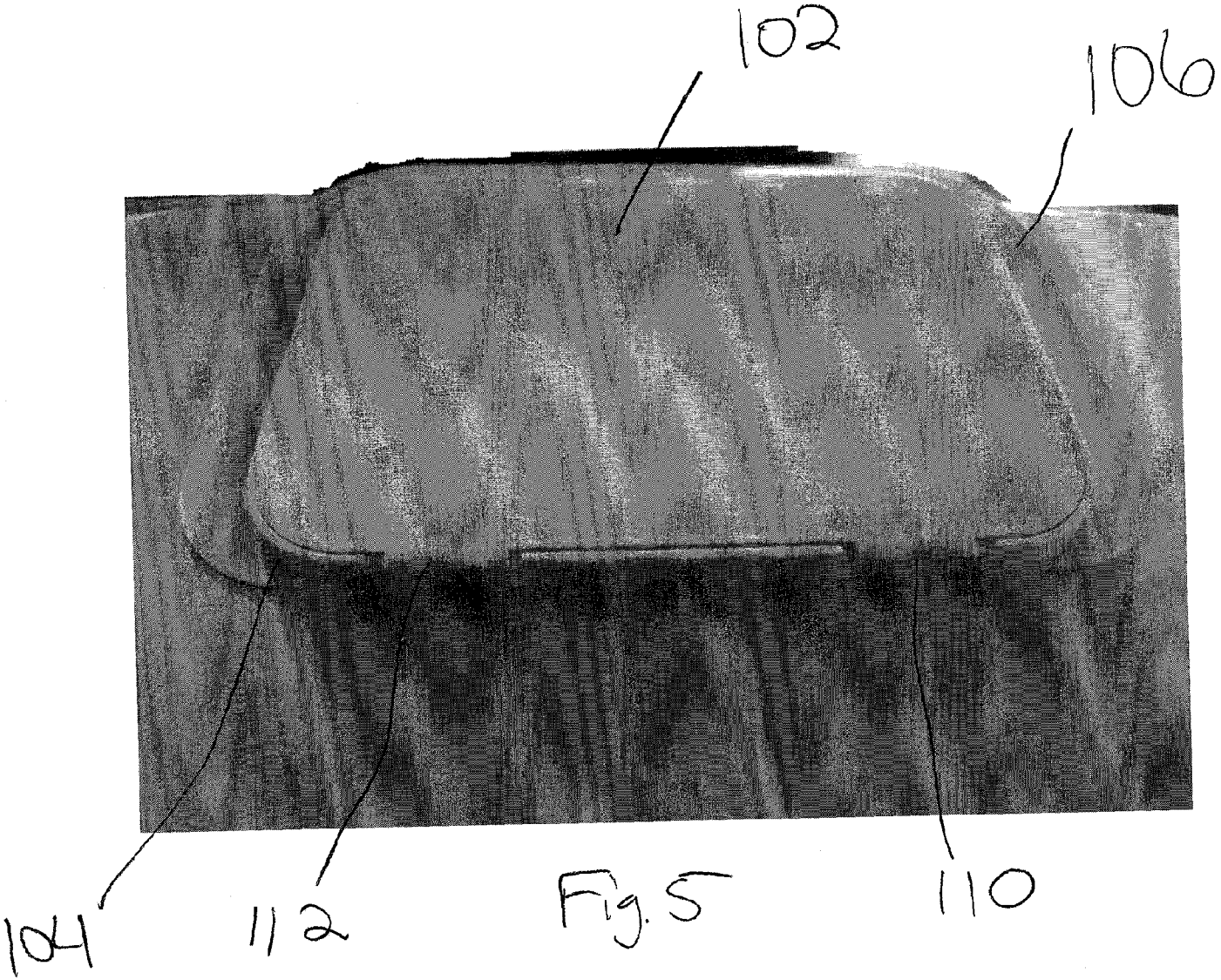
FIG. 5 is a rear isometric view thereof.

FIGS. 2, 4, and 5 show pivots 110, 112 that attach sealing head 102 to sealing shoulder 104. In one embodiment, the sealing head 102 may be attached to sealing shoulder 104 by hinges. Other embodiments may use known pivotal attachments. Another embodiment may not have the sealing head attached to the sealing base.

Figure 3:
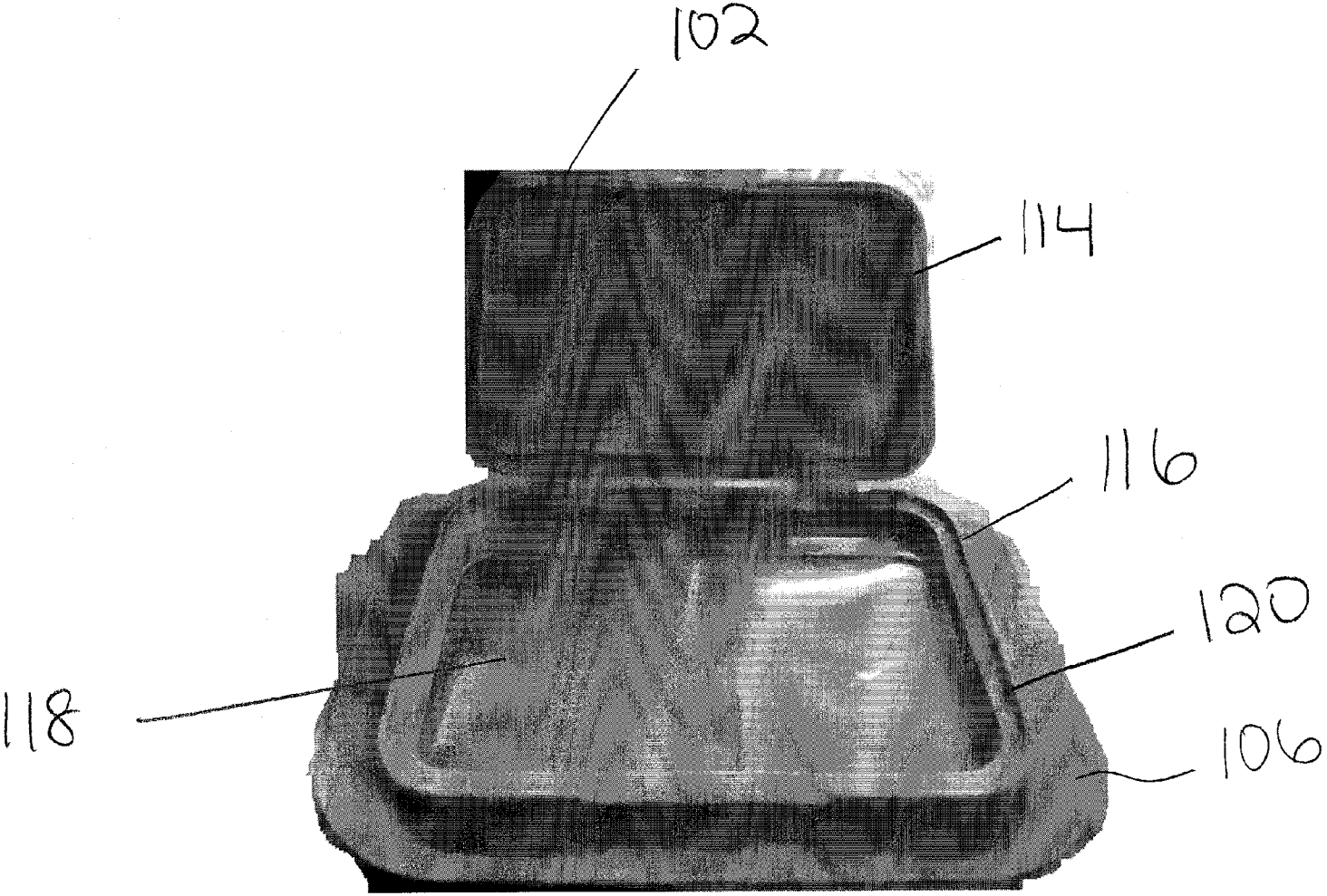
FIG. 3 is another isometric view thereof.

Referring to FIG. 3, the seal will be explained in greater detail. Upper lip 114 of sealing head 102 extends downwards from sealing head 102. Lower lip 116 extends upwards from sealing base 104. The upper lip 114 sits inside of lower lip 116 to create the seal when sealing head 102 is secured to sealing shoulder 104 in the sealed position. The access aperture 118 is located interior of lower lip 116 to maintain the seal created by reclosure body 100. Access aperture provides access to the contents found within packaging 120.

FIG. 6 shows a side view of upper lip 114 and lower lip 116 to demonstrate the seal created by sealing head 102 and sealing shoulder 104. Furthermore, FIG. 6 shows access tab 108. Access tab 108 creates a small aperture that can be used to open the sealing head 102 with a flat head. Upper lip 114 extends slightly inward at tab lip 109 to provide a seal at access tab 108. Tab lip 109 also prevents a user from inserting the flat head into the packaging.

Figure 7:
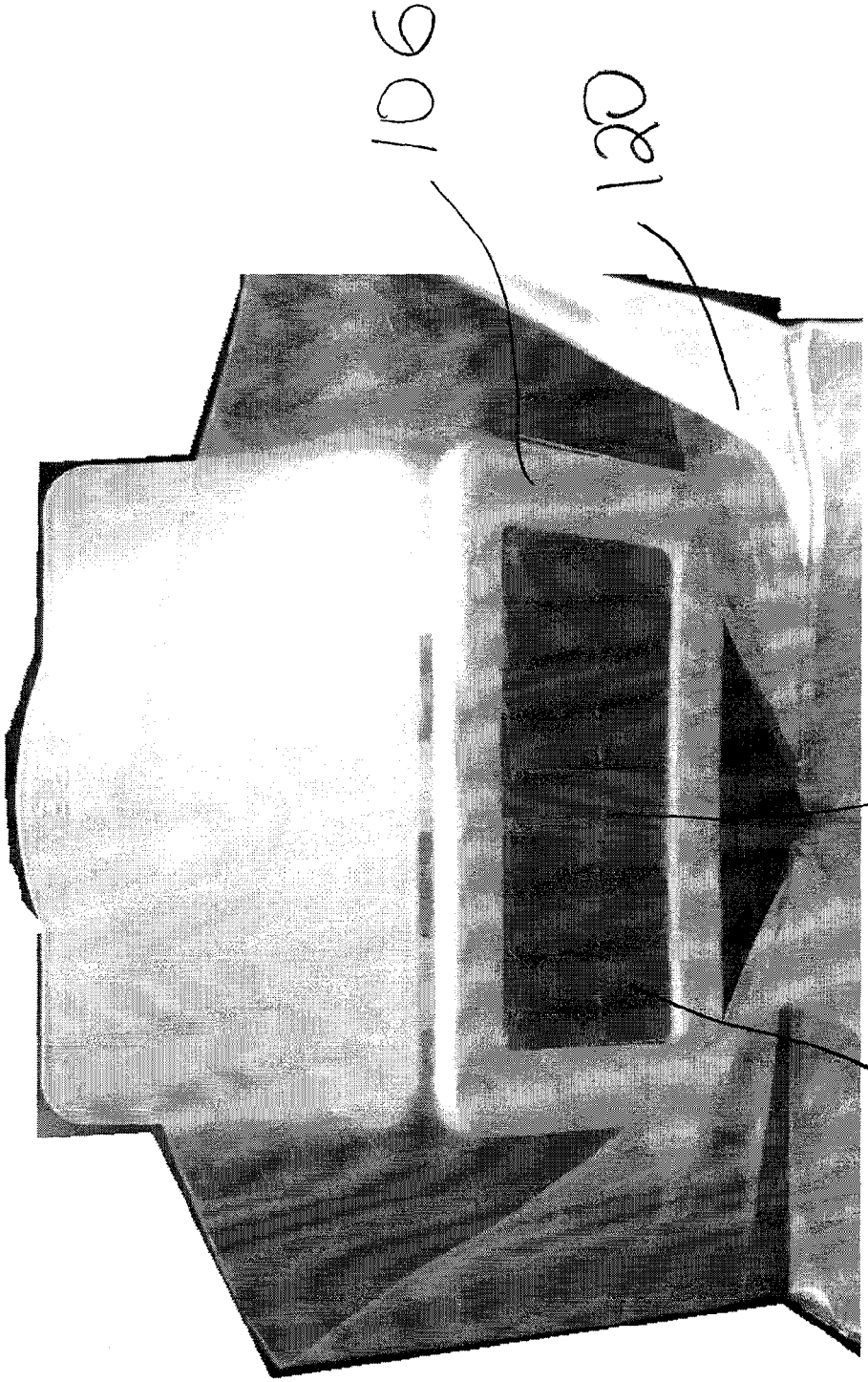
FIG. 7 is a bottom view of one embodiment of the present invention.

FIG. 7 shows another embodiment of the present invention utilizing a different design. Access aperture 118 provides a packaging aperture 122 to allow a user to access the contents within packaging 120.

Figure 9:
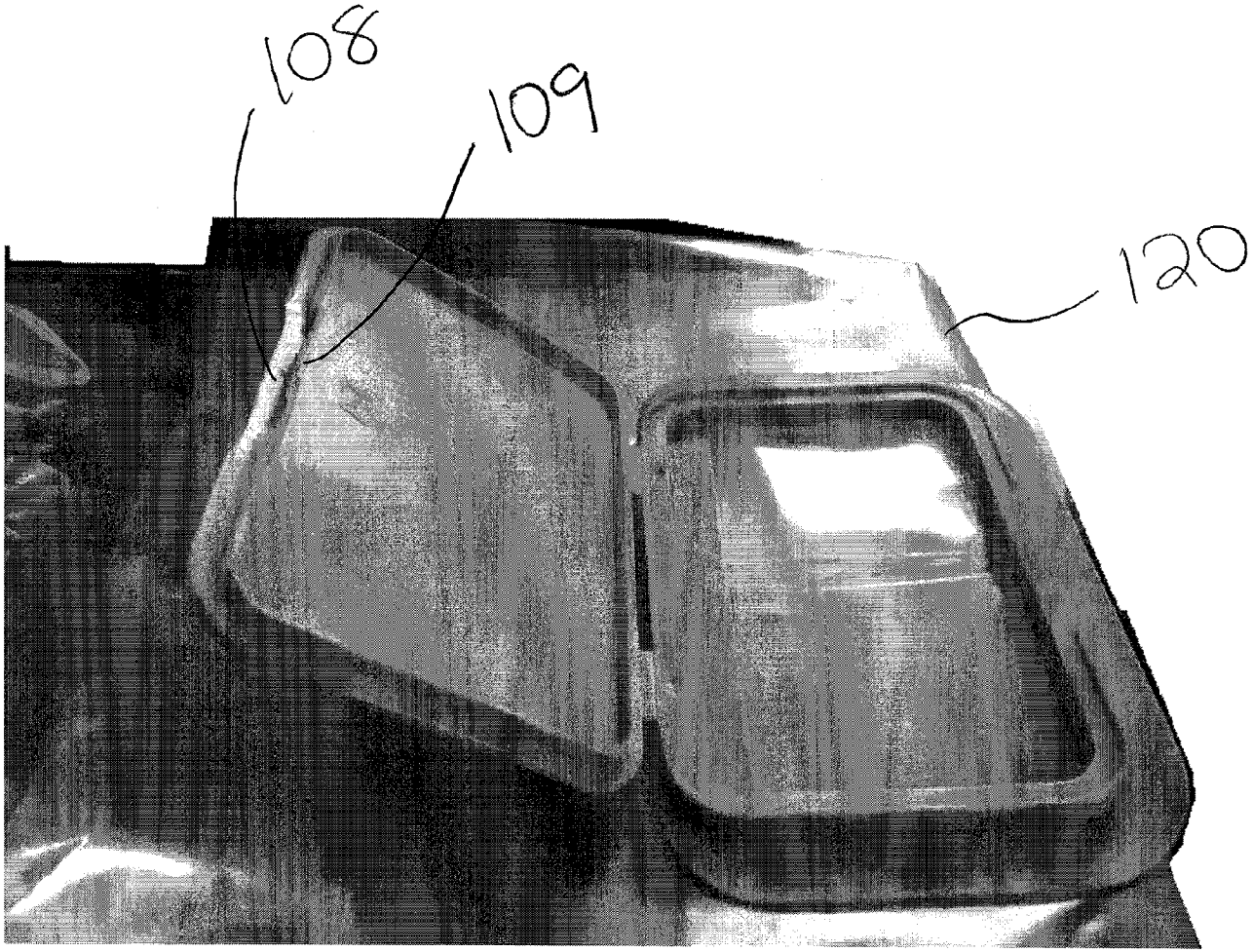
FIG. 9 is a side isometric view thereof.
Figure 8:
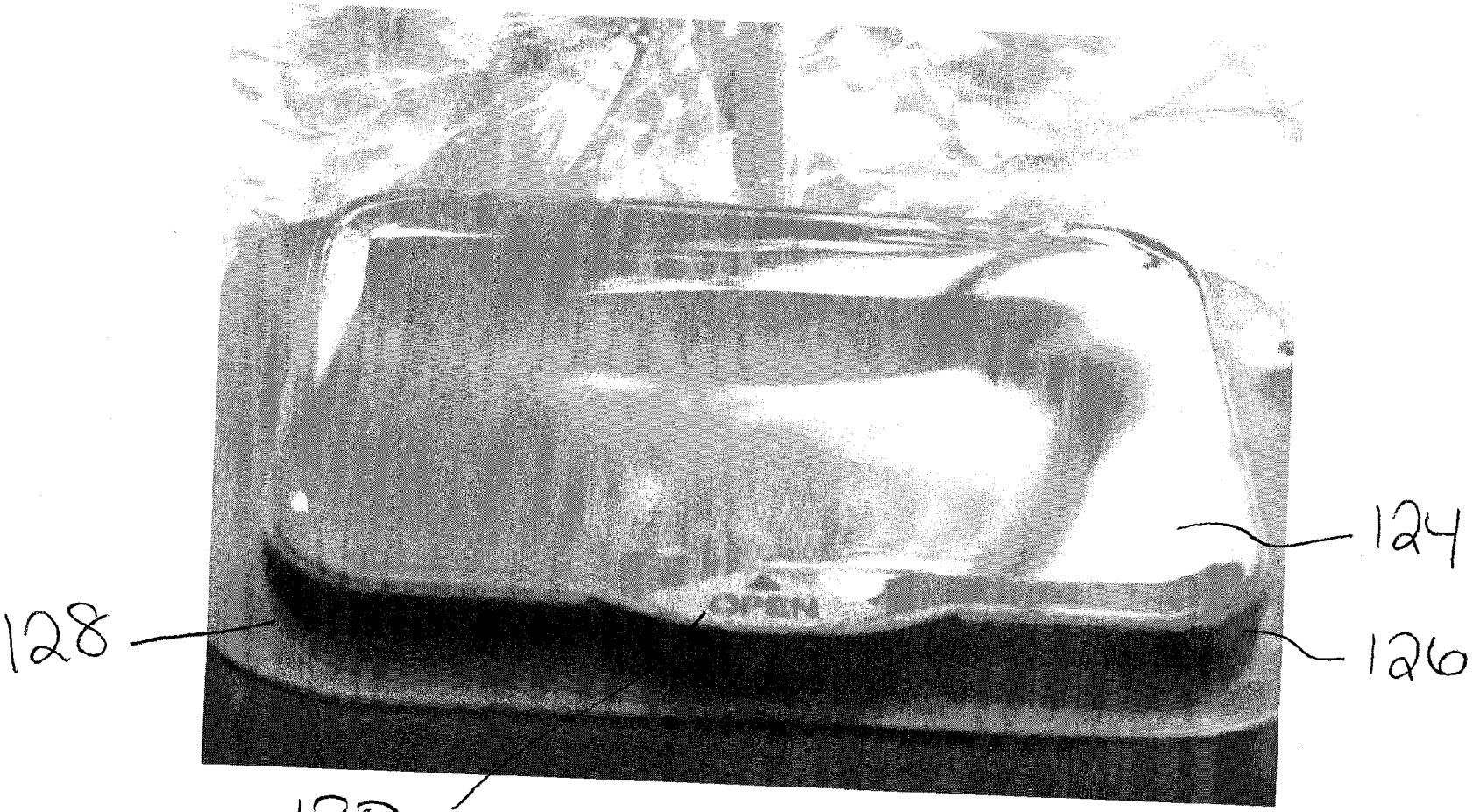
FIG. 8 is a front isometric view of one embodiment of the present invention.
Figure 9:
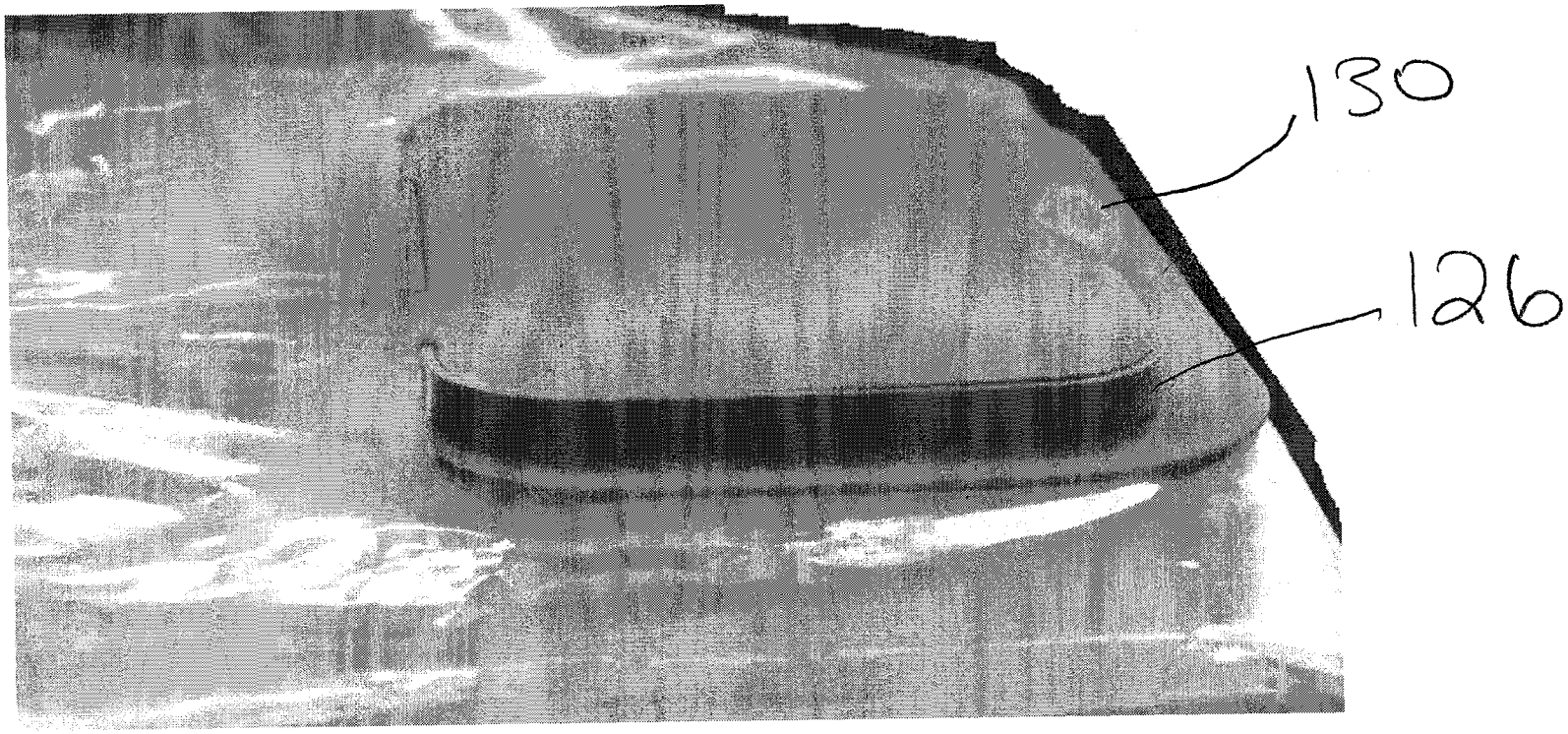

FIGS. 8 and 9 show another embodiment of the present invention utilizing access tab 130. In this embodiment, access tab 130 extends from sealing head 124 beyond sealing shoulder 126. Access tab 130 extends outward above sealing base 128. The extension above sealing base 128 allows a user to place his finger between sealing base 128 and access tab 130 to manipulate sealing head 124.

Figure 10:
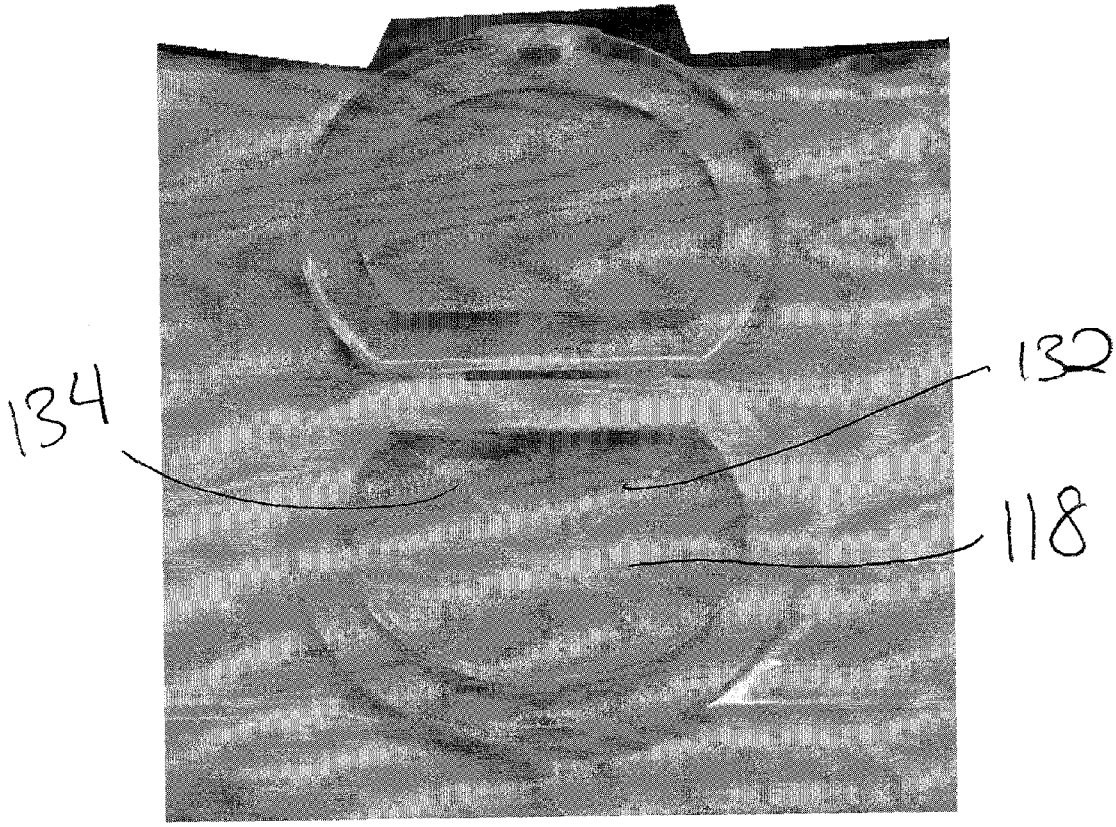
FIG. 10 is a top view of one embodiment of the present invention.

FIG. 10 shows another embodiment of the present invention utilizing a different design. Access aperture 118 provides packaging apertures 132, 134 to allow a user to access the contents within packaging 120. Packaging apertures 132, 134 cross to increase a user's access to the contents of the packaging.

Figure 11:
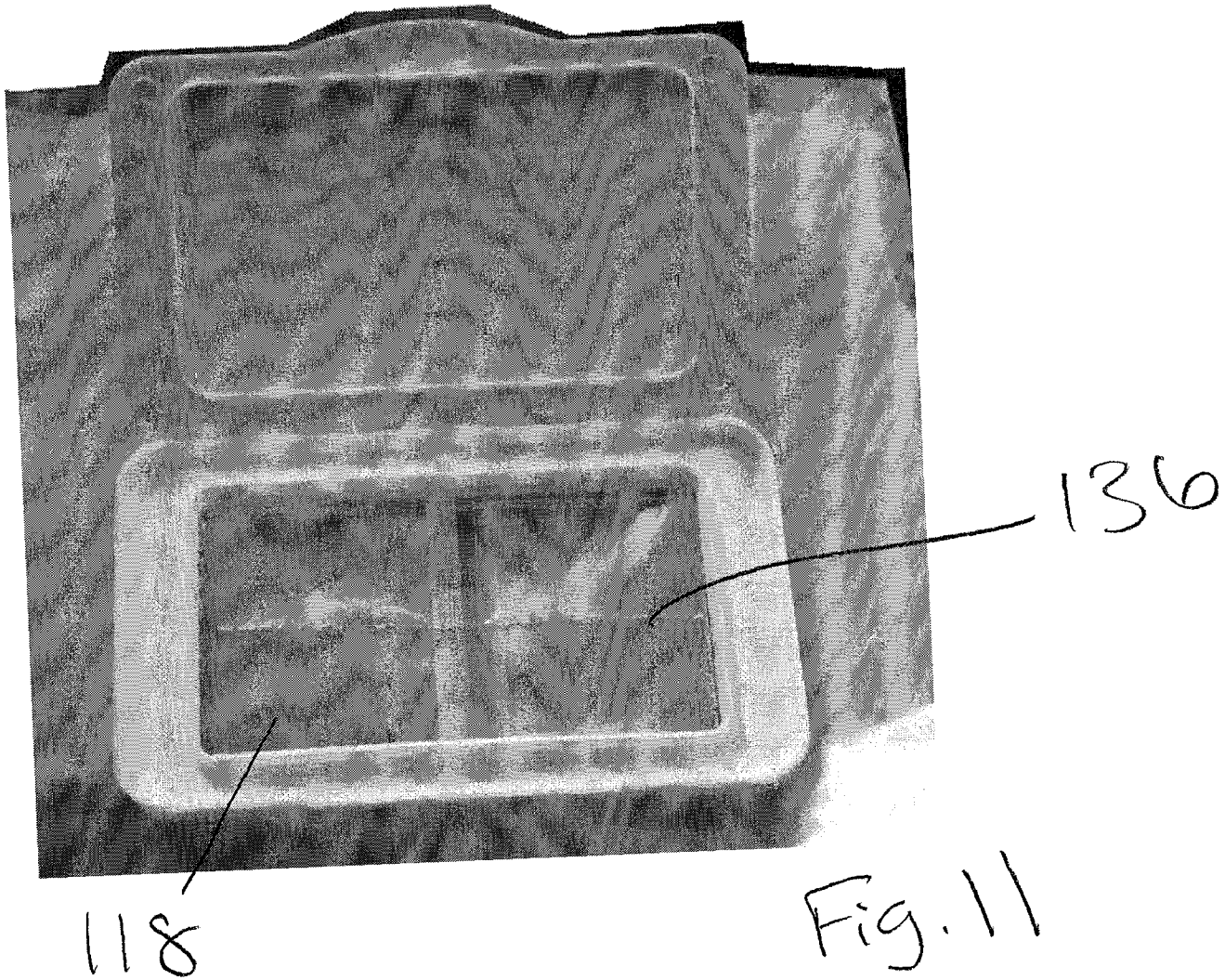
FIG. 11 a top view of one embodiment of the present invention.
Figure 12:
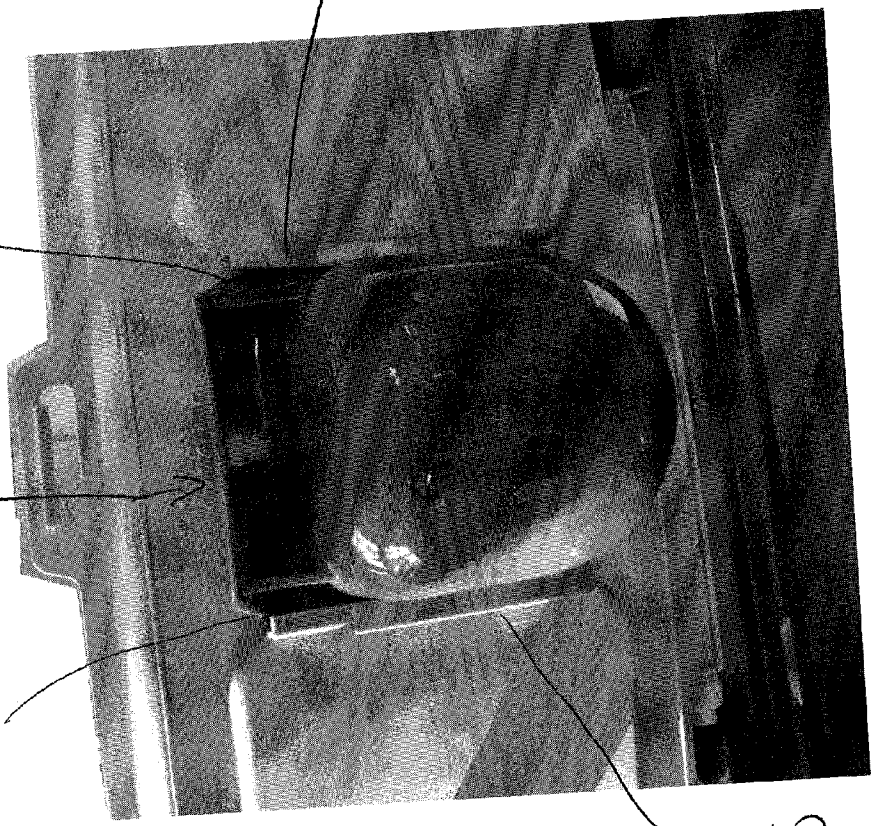
FIG. 12 is an environmental view of one component of one embodiment of the present invention.

FIG. 11 shows another embodiment of the present invention utilizing a different design. Access aperture 118 provides packaging aperture 136 to allow a user to access the contents within packaging 120.

The sealing head 102 adjusts between a closed position as shown in FIG. 1 to an open position in FIG. 3. The reclosure body 100 attaches to the packaging 120. The user adjusts the sealing head 102 to the open position to gain access to the access aperture. As discussed above, one embodiment of the present invention may provide a packaging aperture. In another embodiment, the packaging does not provide precut perforations at the access aperture. In such an embodiment, a user must create a packaging aperture to gain access to the contents of the packaging. The user may cut the packaging to create a packaging aperture or otherwise puncture the packaging.

Another embodiment of the present invention allows the user to pour the contents from the packaging. A user opens sealing head and pours the contents of the packaging. The sealing shoulder may be formed to include a spout to assist the user with pouring the contents from the packaging.

FIGS. 12-17 show the scoop taught by the present invention. This invention may store granular material for which a user would prefer to use a scoop when handling. The present invention provides a scoop 146 that attaches to sealing head. Scoop may attach to sealing head by attachment lips shown in FIG. 12, attachment fingers shown in FIGS. 16 and 17, or other known methods of attachment, such as Velcro, fasteners, etc.

Scoop 146 has two scoop fingers 142, 144 that extend outwards from scoop 146. Sealing head provides two attachment lips 138, 140. Attachment lips 138, 140 create an aperture between attachment lips 138, 140 and sealing head. Scoop fingers 142, 144 are sized to fit inside of the apertures created by attachment lips 138, 140. Attachment lips 138, 140 accept scoop fingers 142, 144 such that scoop fingers 142, 144 slideably engage attachments lips 138, 140 to secure scoop 146 to the sealing head. Attachment lips 138, 140 extend vertically away from sealing head and inwards toward the location where scoop 146 will be stored. The shape of the attachment lips 138, 140 secure scoop 146 within scoop fingers 138, 140.

Figure 13:
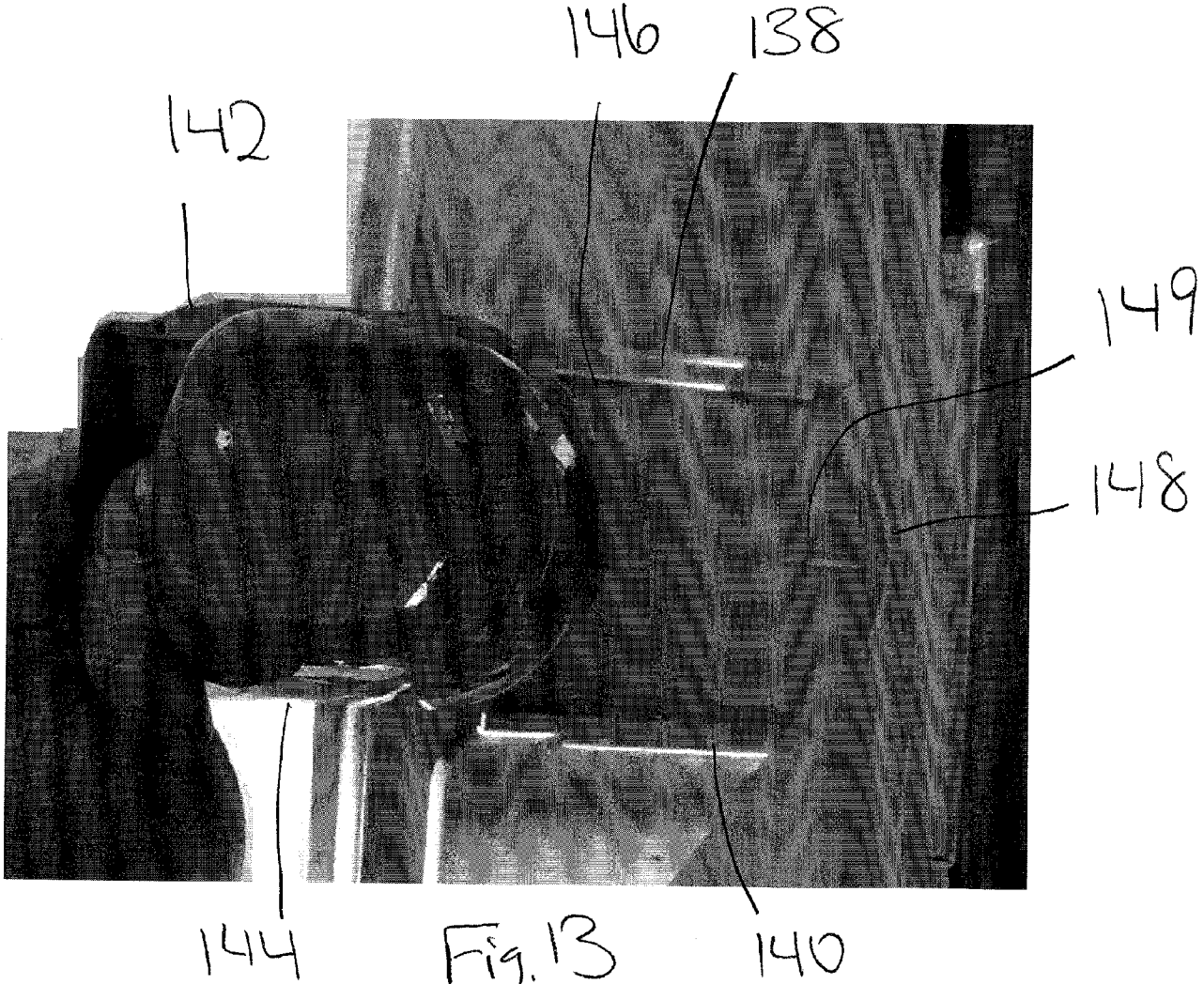
FIG. 13 is an environmental view of one component of one embodiment of the present invention.
Figure 14:
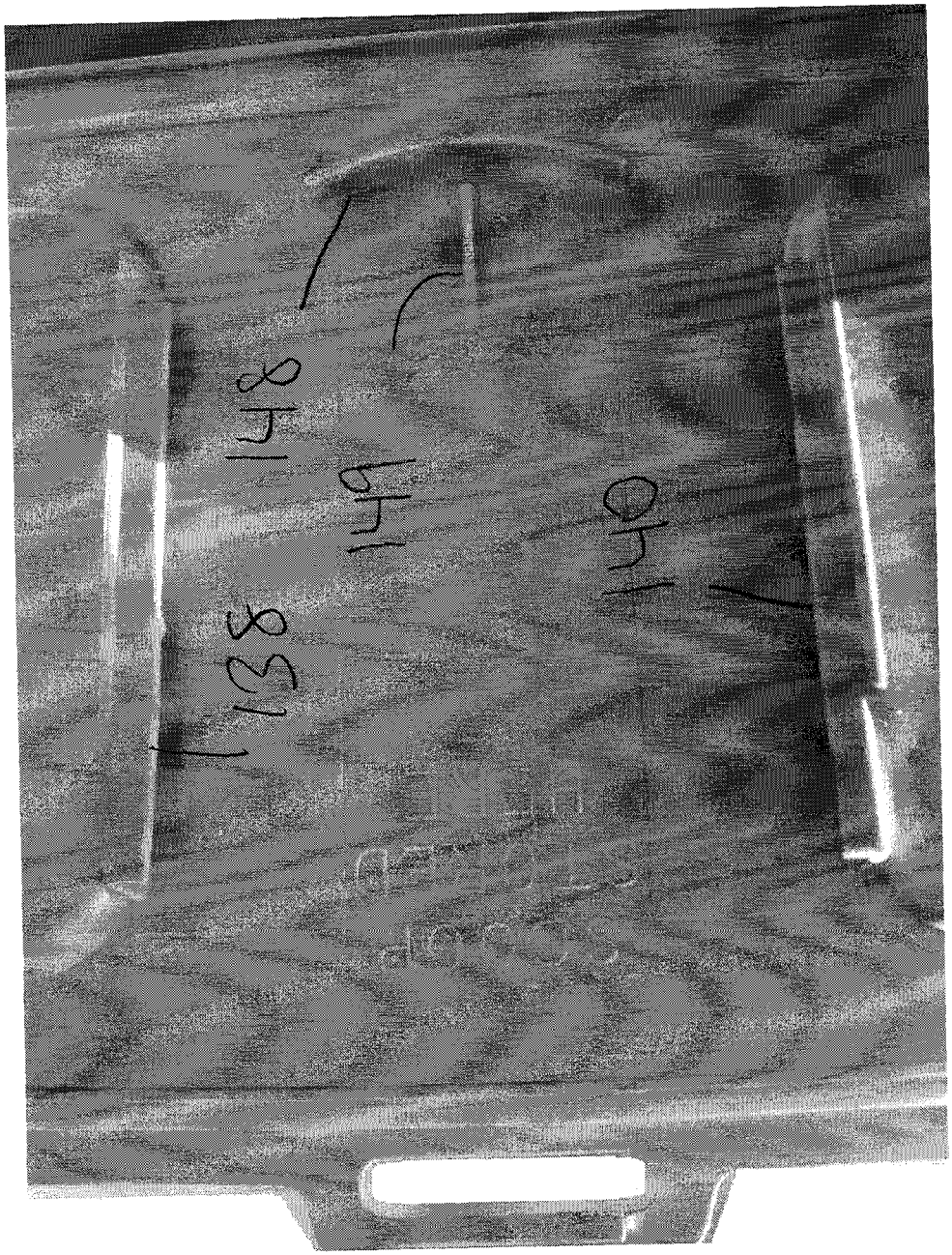
FIG. 14 is an environmental view of one component of one embodiment of the present invention.

FIG. 13 shows the sliding engagement of scoop 146 with attachment lips 138, 140. Scoop fingers 142, 144 are inserted between the attachment lips 138, 140 and the sealing head. A user moves scoop 146 towards the opposite end of the attachment lips 138, 140 to secure the scoop 146 to sealing head. FIG. 14 shows scoop 146 removed from the attachment lid. As seen in FIGS. 13 and 14, one embodiment of the present invention provides a blocking lip 148 that prevents the scoop 146 from being pushed through attachment lips 138, 140. In addition, the present invention may include a locking lip 149 that secures the placement of scoop 146. Locking lip 149 provides a slanted structure that allows the scoop to easily slide over locking lip 149 when installing the scoop 146 on the sealing head. Locking lip 149 can be an inclined plane on which the scoop 146 moves up when adjusted towards blocking lip 148 to be installed on sealing head. Locking lip 149 stops short of blocking lip 148 such that the scoop 146 is not located on the locking lip 149 when installed on sealing head. Therefore, scoop 146 must be adjusted vertically around locking lip 149 to remove scoop 146 from sealing head. Scoop 146 will not freely move backwards. Locking lip 149 prevents accidental removal of scoop 146 from sealing head.

Figure 15:
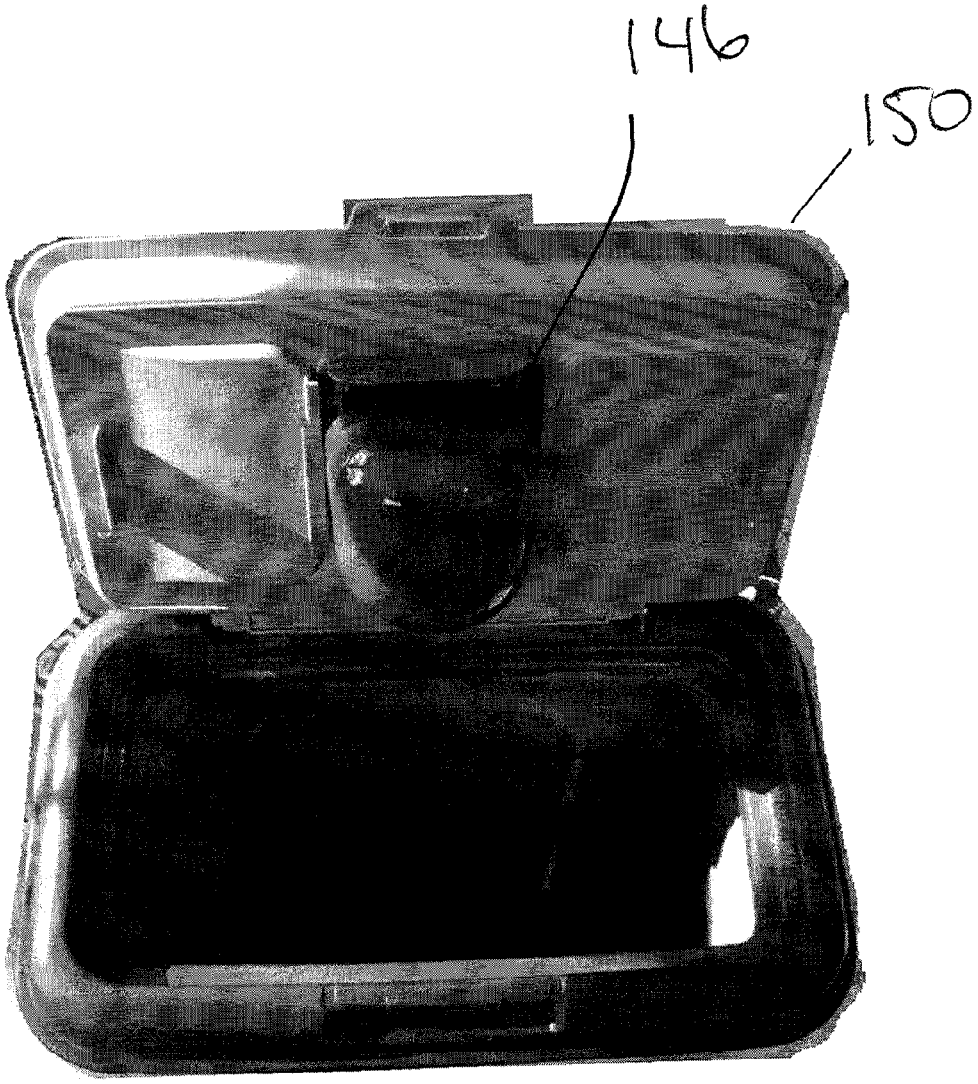
FIG. 15 is an environmental view thereof.

FIG. 15 shows an environmental view of the scoop 146 attached to sealing head 150. FIG. 15 shows an embodiment in which the scoop 146 attaches such that the scoop will be stored inside of the packaging. In this embodiment, attachment lips are located on the interior side of the sealing head. The scoop may also be attached exterior of the packaging. In such an embodiment, attachment lips are located on the exterior side of the sealing head.

Figure 16:
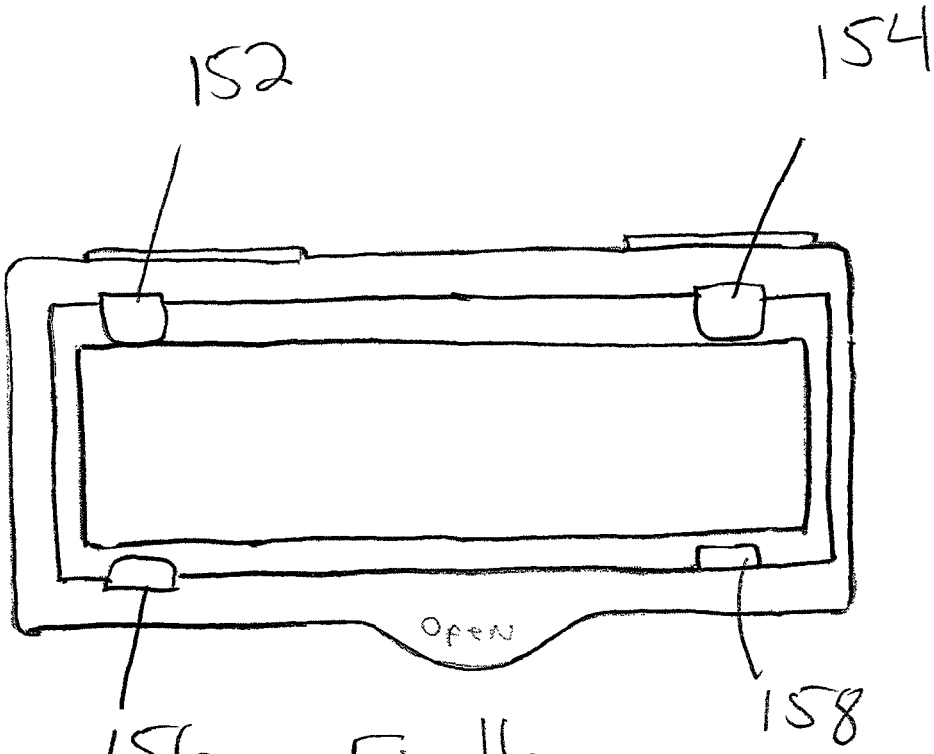
FIG. 16 is a top view of one embodiment of the present invention.
Figure 17:
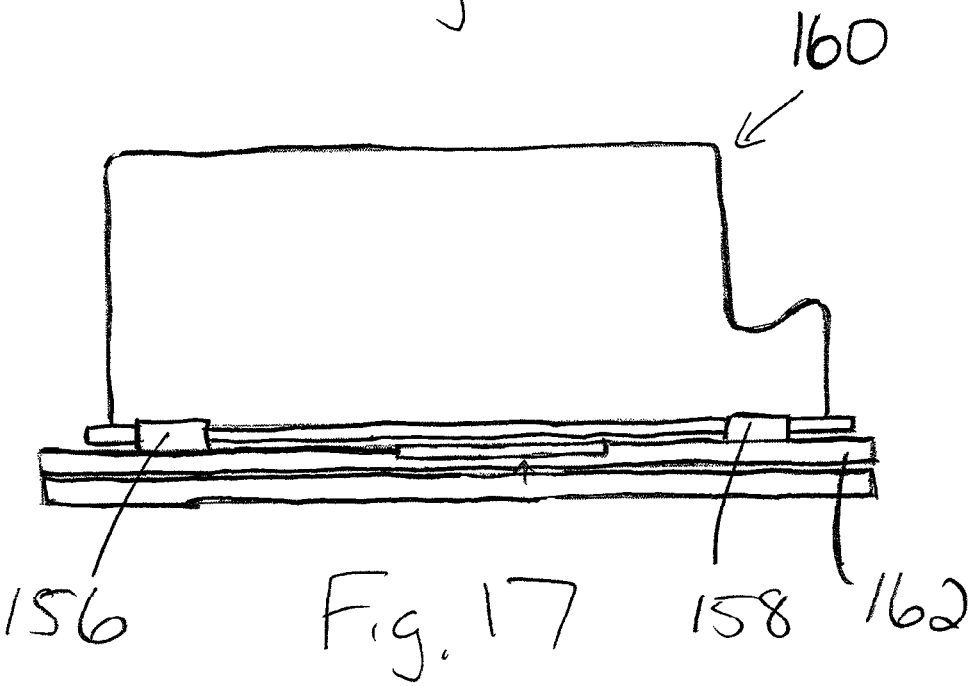
FIG. 17 is side view thereof.

FIGS. 16 and 17 show retaining fingers 152, 154, 156, 158 that attach the scoop. The present invention may also use retaining snaps to secure scoop to the sealing head.

Figure 18:
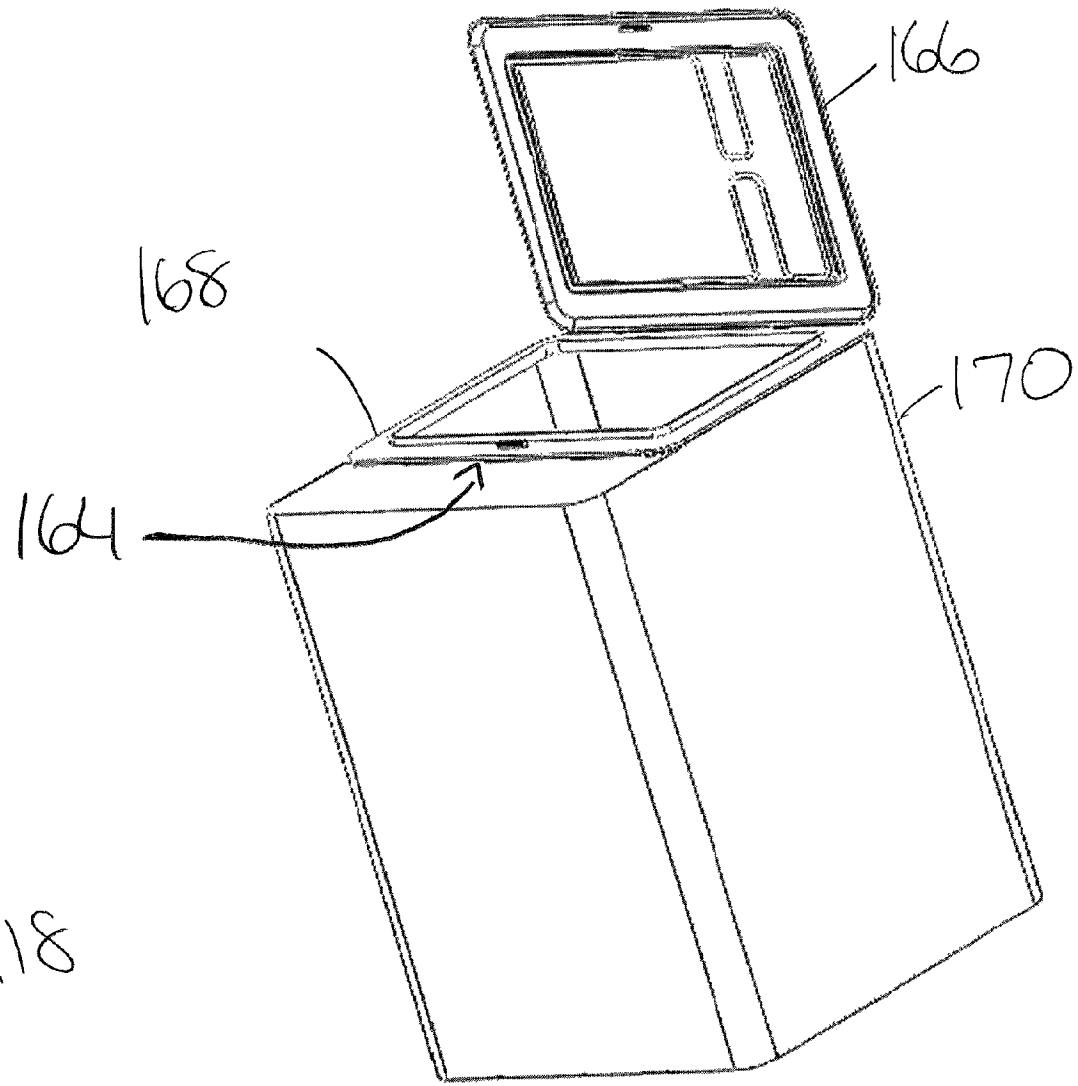
FIG. 18 is a perspective view of one embodiment of the present invention.

FIG. 18 shows another embodiment of the present invention in which the sealing device 164 is attached to flexible packaging 170. Flowable material, including but not limited to fluids, powders, grains, lawn care products, granular material, etc., may be stored within packaging 170. The sealing device 170 is constructed from a lid 166 and a base 168. The lid 166 secures to the base 168 to maintain the contents within the packaging 170. The lid 166 adjusts between an open position and a closed position. In the open position, the user can access the contents of the packaging 170. In the closed position, the lid 166 is secured to the base 168 such that the user cannot gain access to the contents of the packaging 170.

Figure 19:
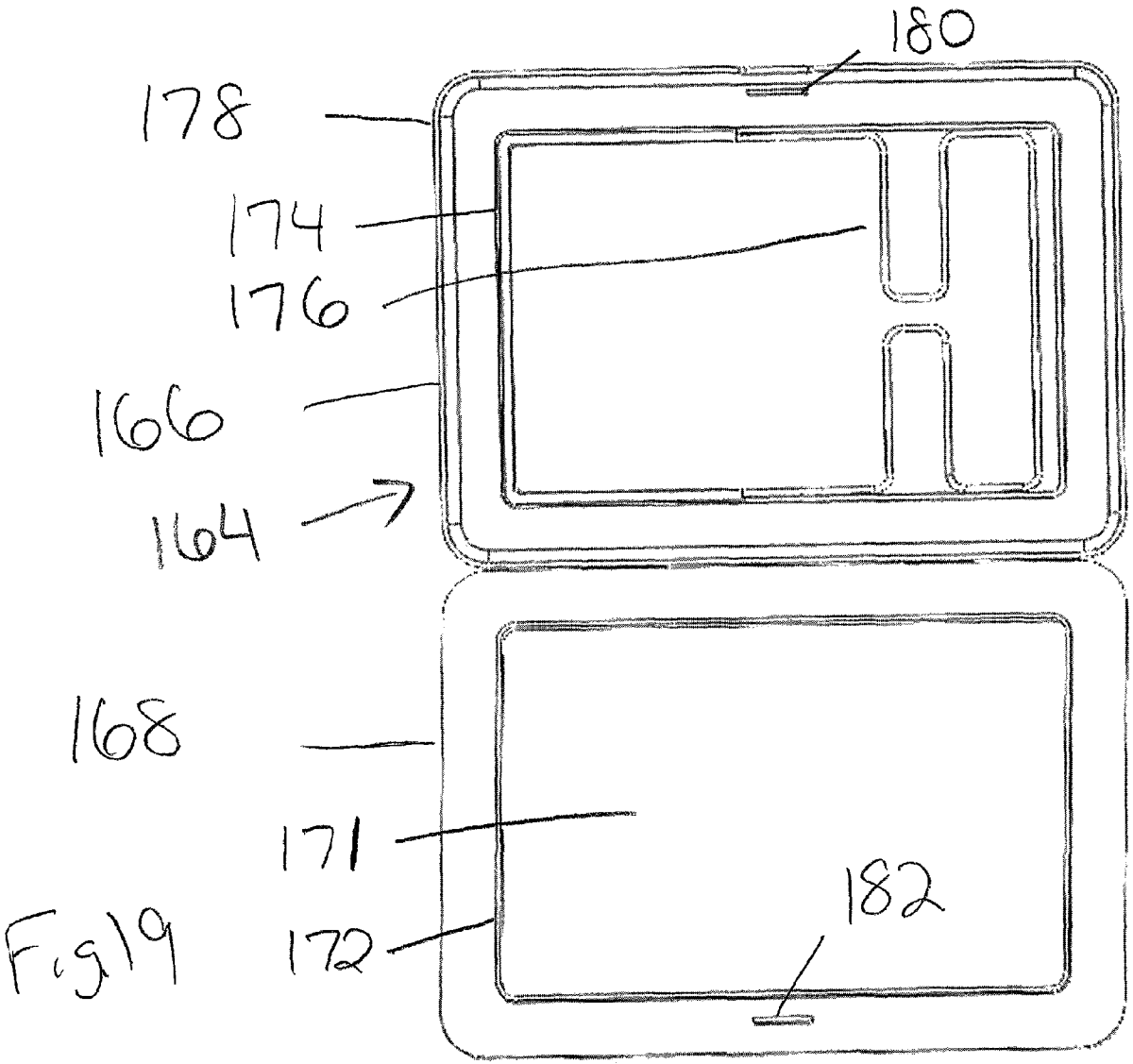
FIG. 19 is a top view of a portion of one embodiment of the present invention.
Figure 20:
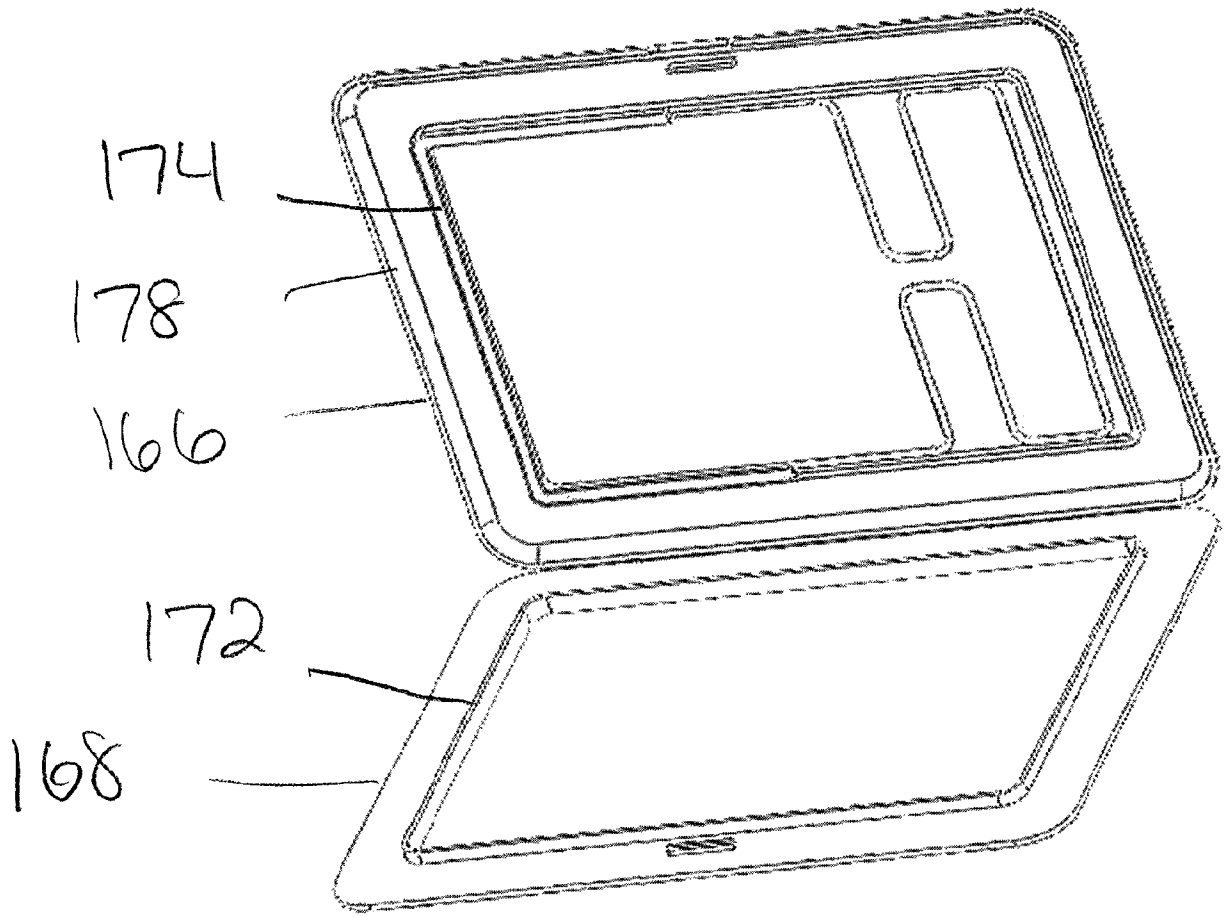
FIG. 20 is a perspective view thereof.

FIGS. 19 and 20 show a more detailed view of the sealing device 164 with scoop 176 secured to the lid 166. Shoulder 172 extends outward from the base 168. The shoulder 172 provides surface area for contact with the lid 166. The neck 174 of lid 166 extends outward from the lid 166. The neck 174 and shoulder 172 provide additional surface area of the lid 166 and base 168 to increase the contact area for improved sealing of the device 164. The neck 174 and shoulder 172 are located proximate the access aperture 171. The neck 174 is sized slightly smaller such that neck 174 can be positioned interior of shoulder 172. When the lid 166 is adjusted to the closed position, the neck 174 may pass into access aperture 171.

Lip 178, as shown in FIGS. 19-20, 25-29, slopes downwards from the top of lid 166. In one embodiment, lip 178 contacts base 168 when the lid 166 is in the closed position. The contact point between base 168 and lip 178 forms a second seal between the lid 166 and the base 168.

FIGS. 19 and 20 also show the attachment lip found on the underside of the lid 166 for attaching the scoop 176. As described above, the user may slide the scoop 176 between the attachment lip and the lid 166 for the attachment lip to engage the scoop 176. The engagement of the scoop 176 with the attachment lip secures the scoop 176 to the lid 166.

Retention finger 180 of lid 166 contacts retention finger 182 of lid 168 to grip each other for sealing the closure. By applying pressure to adjust the lid 166 to the open position, the user can overcome the grip of the retention fingers 180, 182 to open the lid 166.

Figure 21:
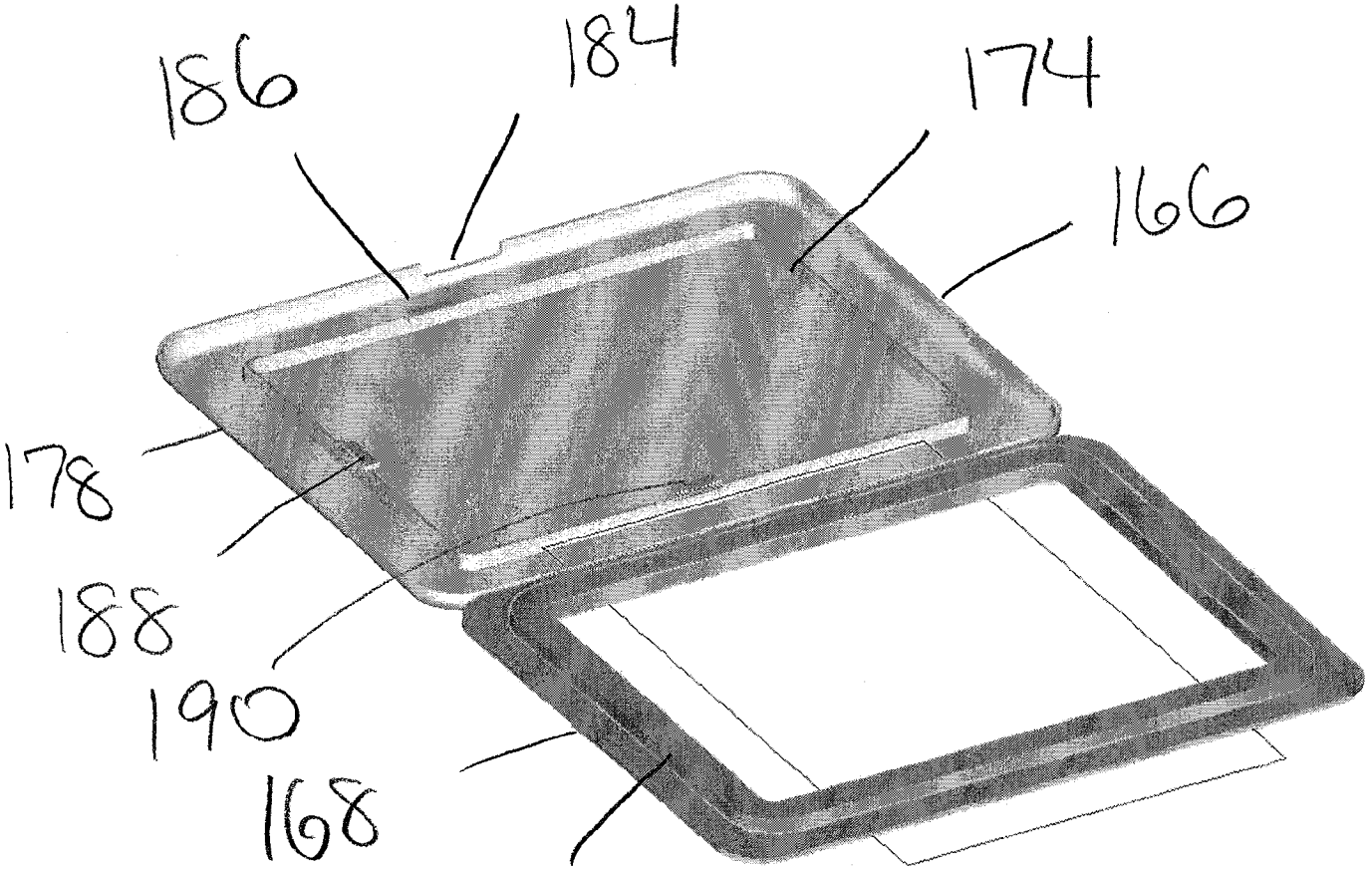
FIG. 21 is a top view of a portion of one embodiment of the present invention.

FIG. 21 shows another embodiment with fastening fingers 186, 188, 190. Fastening fingers 186, 188, 190 extend from neck 174 towards the interior of the lid 166. Neck 174 is sized such that neck 174 may partially pass within shoulder 172. Each fastening finger 186, 188, 190 slides at least partially into access aperture 171. In one embodiment, fastening fingers 186, 188, 190 extend from neck 174 such that fastening fingers 186, 188, 190 contact shoulder 172. Additional fastening fingers may be located on shoulder 172 for securing fastening fingers 186, 188, 190. In another embodiment, apertures may be located on shoulder 172 for securing fastening fingers 186, 188, 190.

Figure 25:
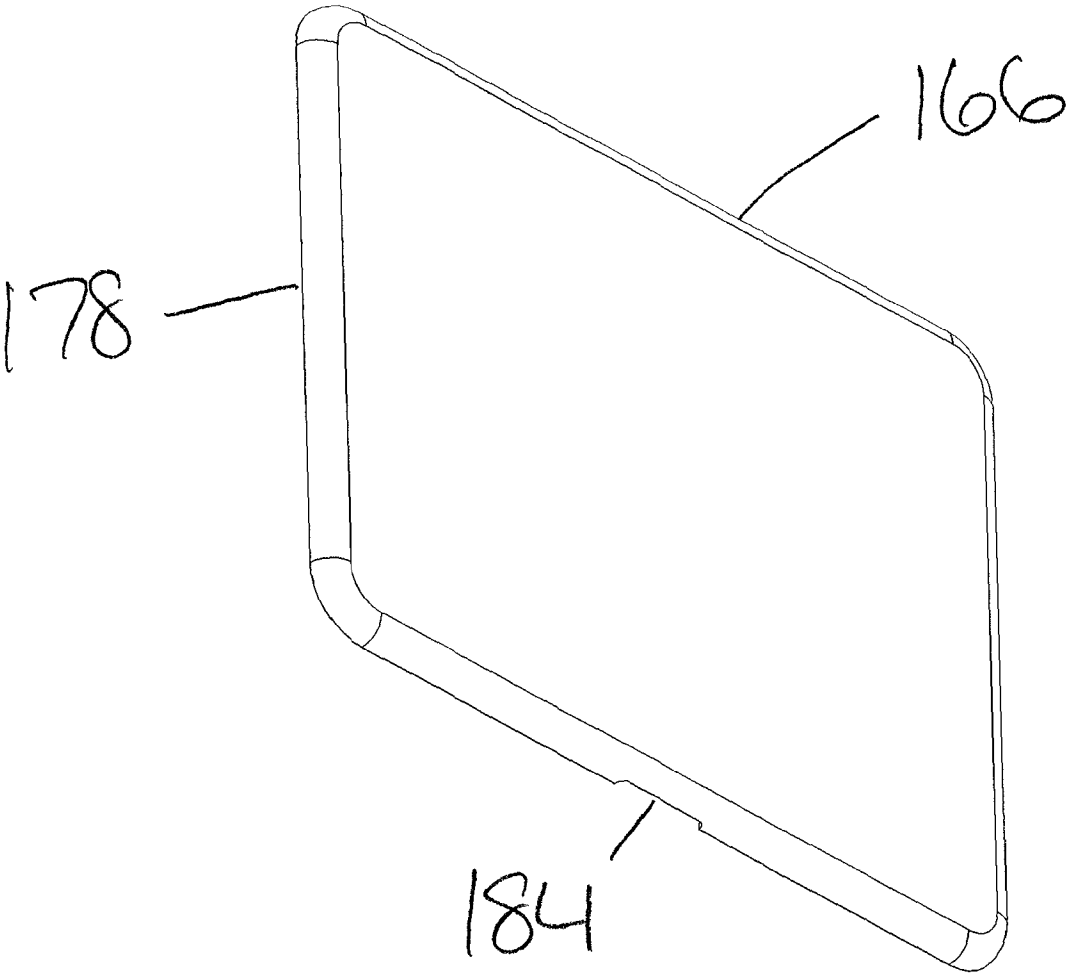
FIG. 25 is a top perspective view thereof.
Figure 28:
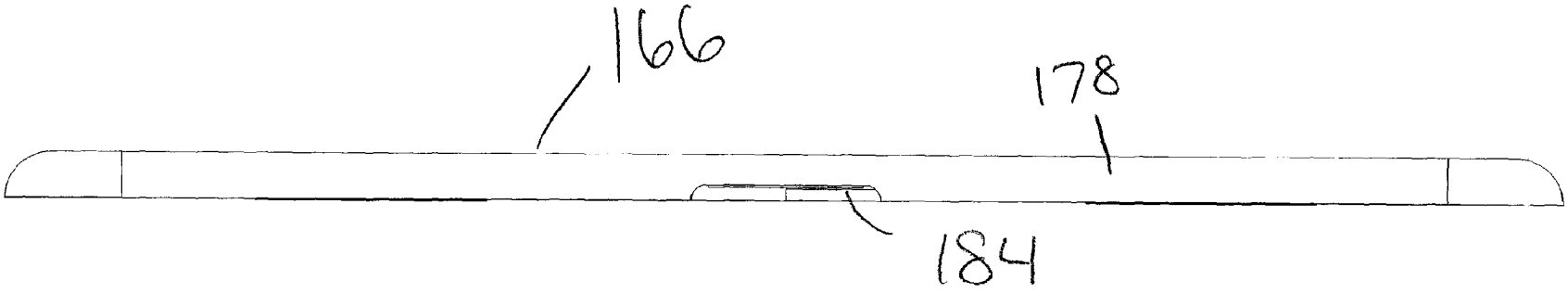
FIG. 28 is a front view thereof.
Figure 28:
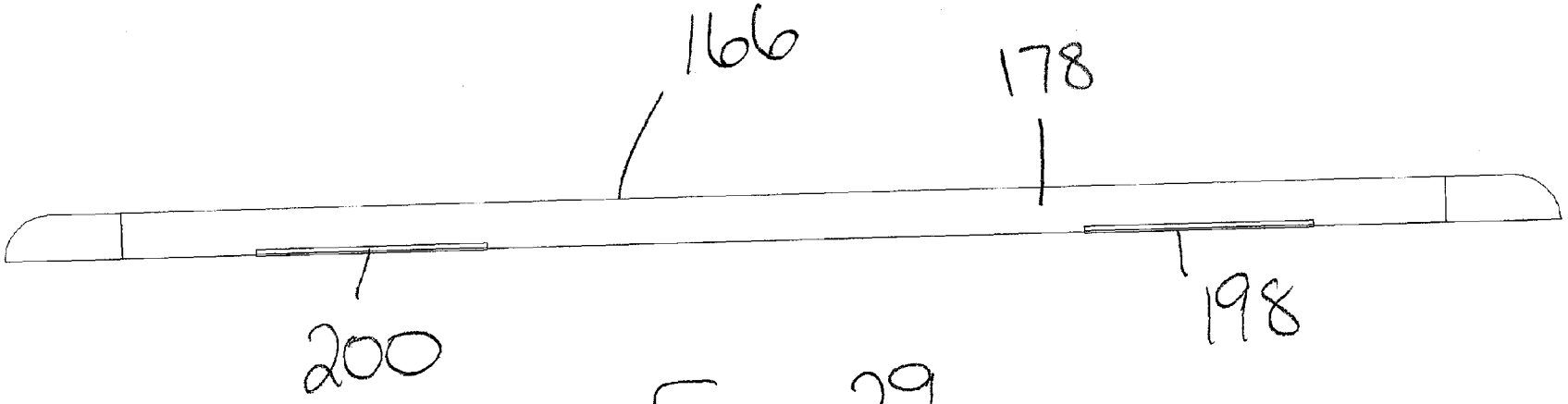
Figure 30:
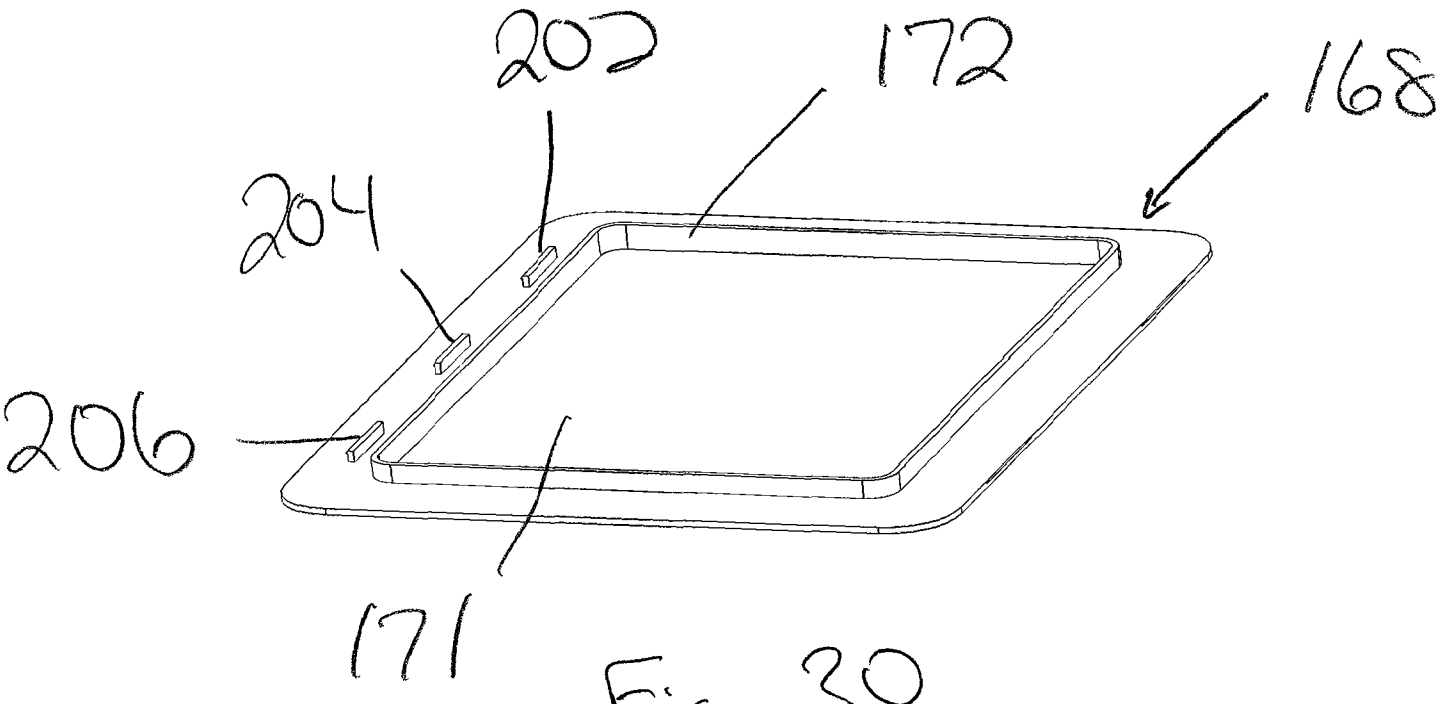
FIG. 30 is a top perspective view of a base of one embodiment of the present invention.

FIGS. 21, 25, and 28 show an embodiment that provides an opening aperture 184. The user inserts an object or finger into opening aperture 184 to adjust the lid 166 into the open position. Such an embodiment may limit some users, such as children, from accessing the contents of the packaging.

Figure 22:
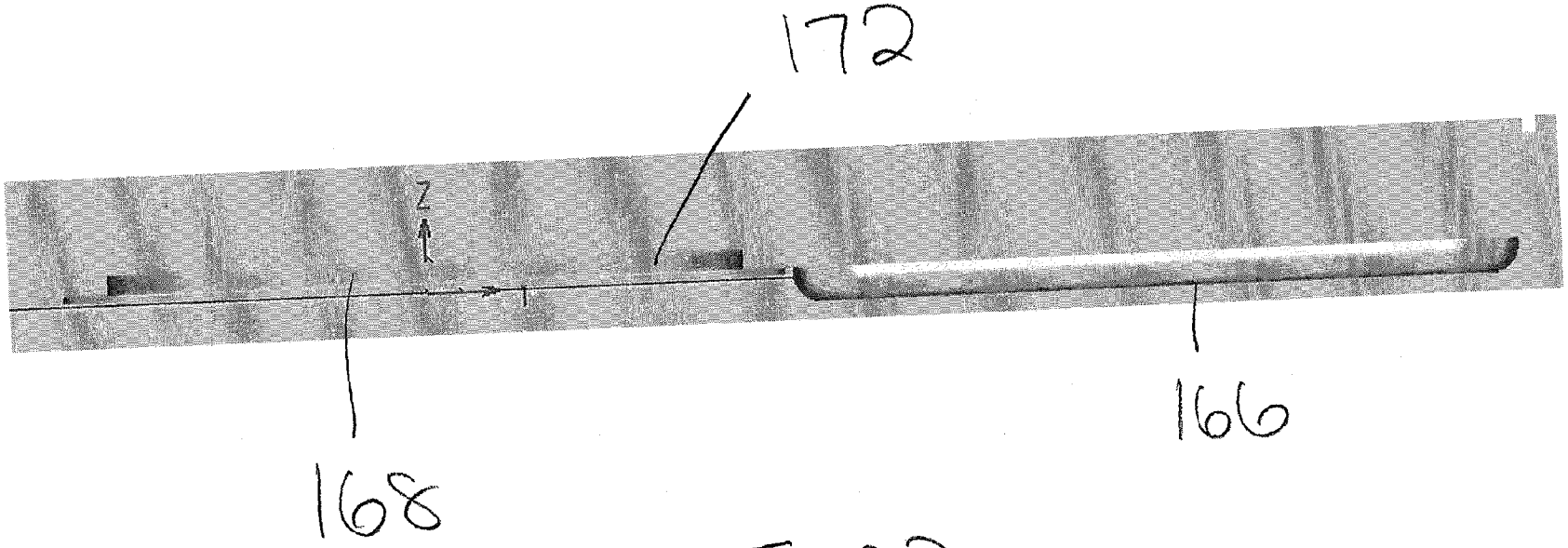
FIG. 22 is a side view thereof.

FIG. 22 shows a side view of the hinged attachment of lid 166 with base 168. Neck 172 extends outward from base 168 for contacting lid 166 when the lid 166 is adjusted to the closed position.

Figure 23:
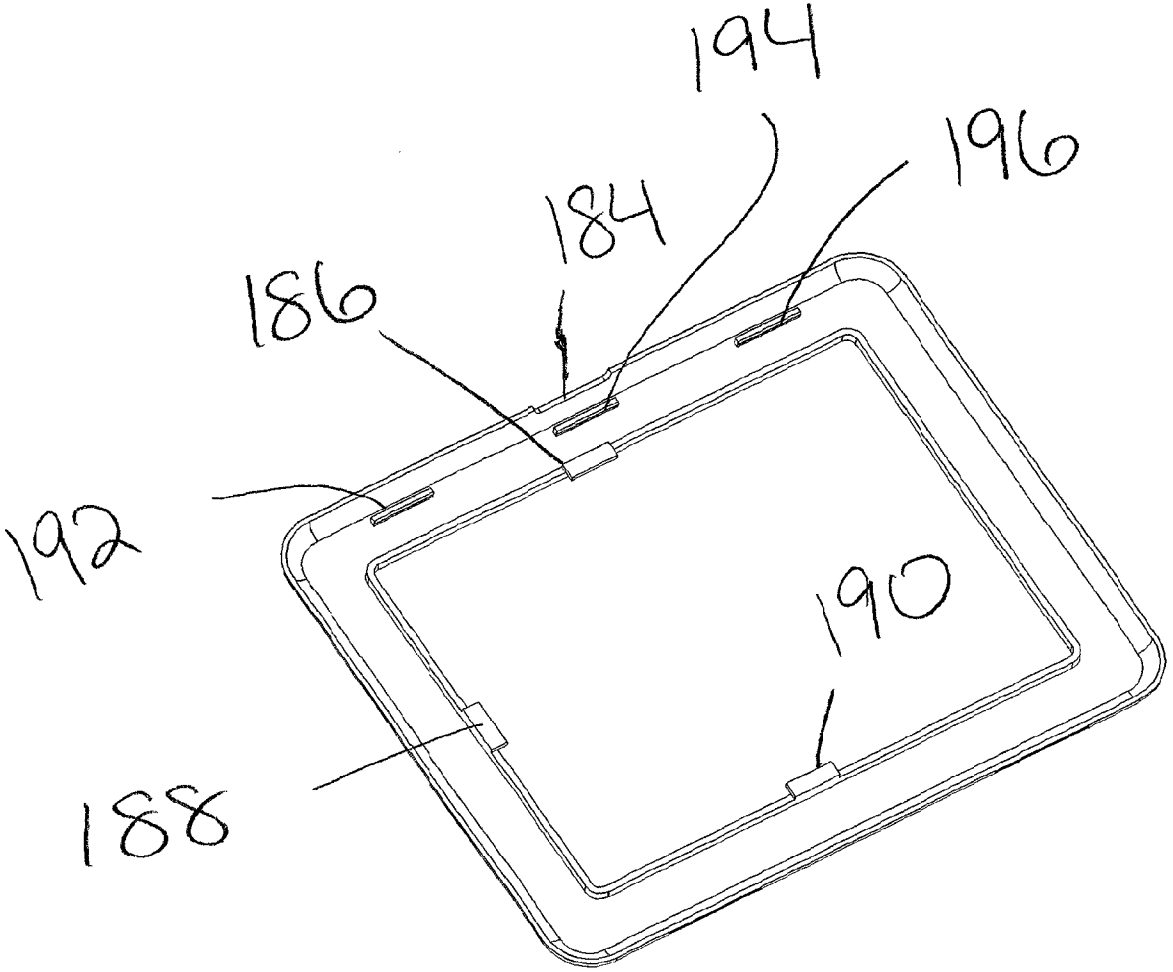
FIG. 23 is a bottom perspective view of a lid of one embodiment of the present invention.
Figure 24:
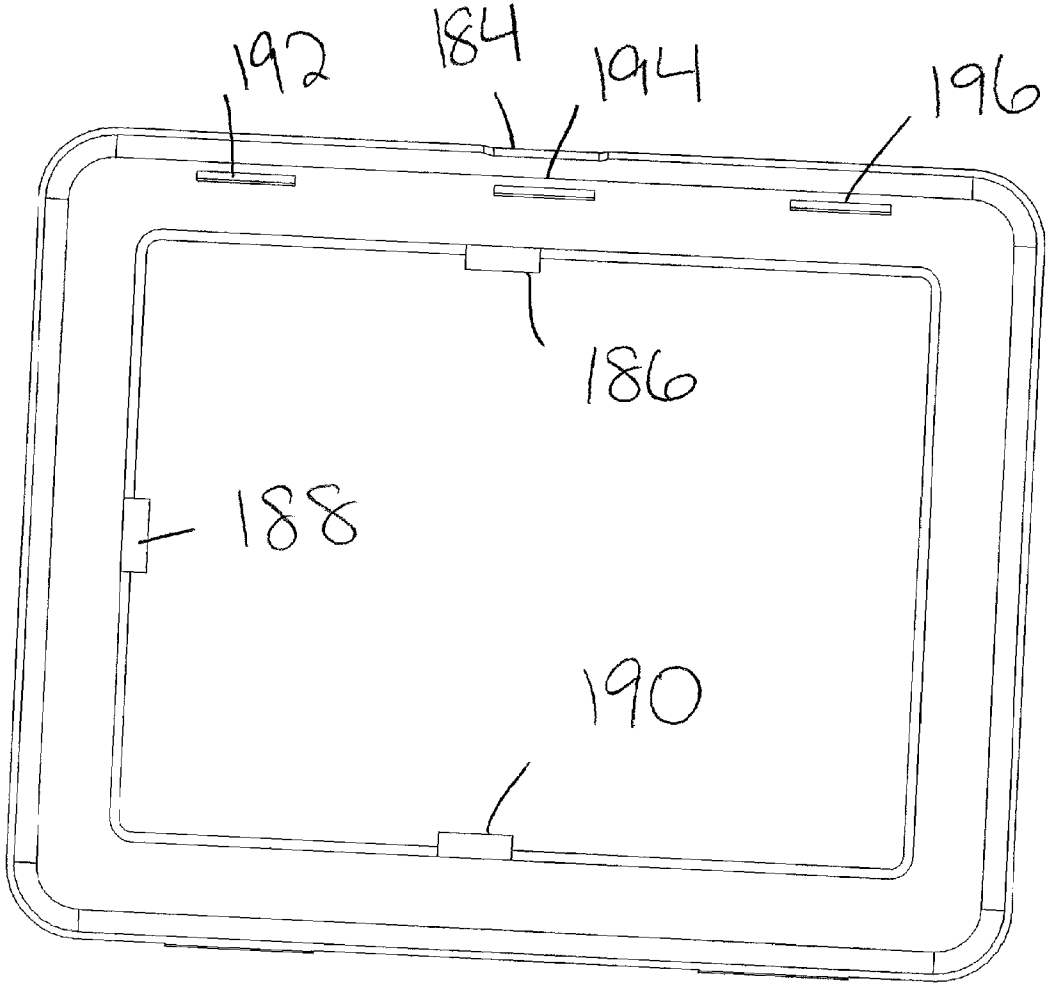
FIG. 24 is a bottom view thereof.

FIGS. 23 and 24 show another embodiment that provides retention fingers 192, 194, 196. Each of the retention fingers 192, 194, 196 provides an extension, similar to a hook. Each retention finger 192, 194, 196 of the lid 166 contacts a corresponding retention finger 202, 204, 206 found on the base 168. The extensions of the retention fingers 192, 194, 196, 202, 204, 206 contact each other to maintain the lid 166 in the closed position. To open the lid 166, the user must overcome the contact of the retention fingers 192, 194, 196, 202, 204, 206.

Figure 26:
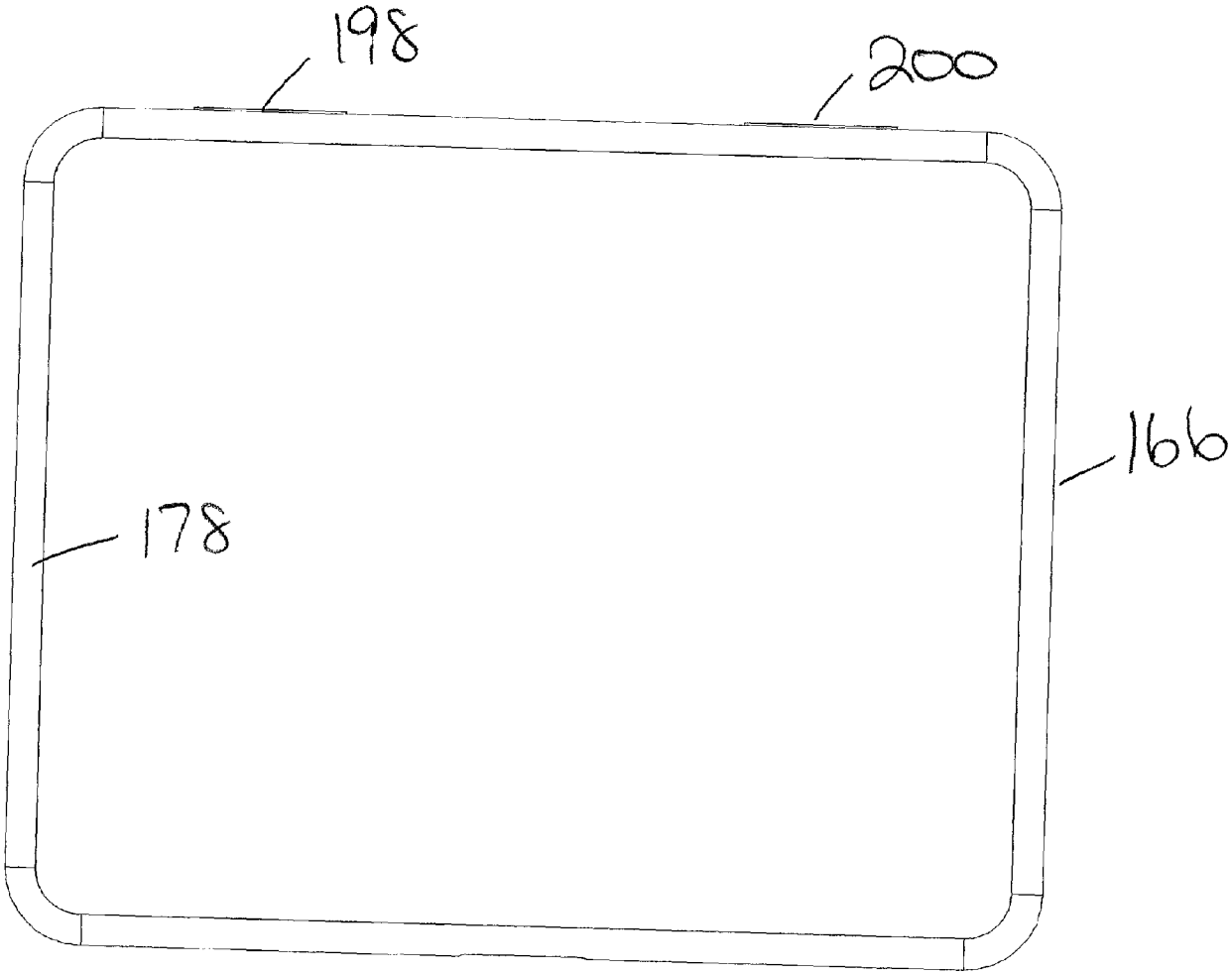
FIG. 26 is a top view thereof.
Figure 27:
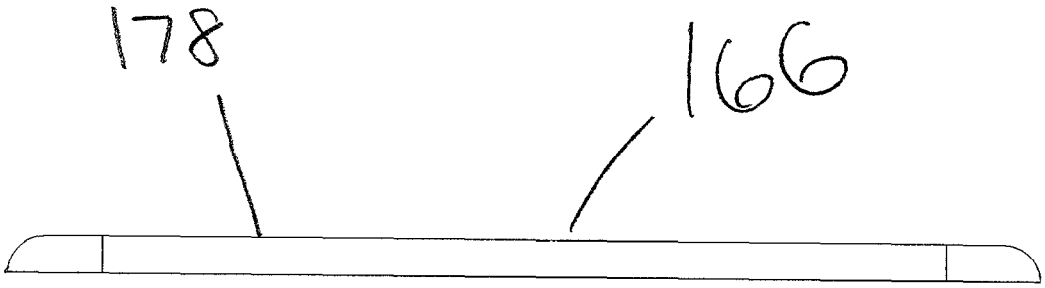
FIG. 27 is a right side view thereof, the left side view being a mirror image of the right side view.

FIGS. 26 and 29 show the hinged attachment of lid 166 with base 168. Hinges 198, 200 attach the lid 166 to base 168. The hinges 198, 200 assist keeping the lid 166 with the base 168. The hinges 198, 200 also assist the user with adjusting the lid 166 between the open position and the closed position. Other embodiments may use pivots or other pivotal attachments. In another embodiment, the lid may not be attached to the base.

Figure 31:
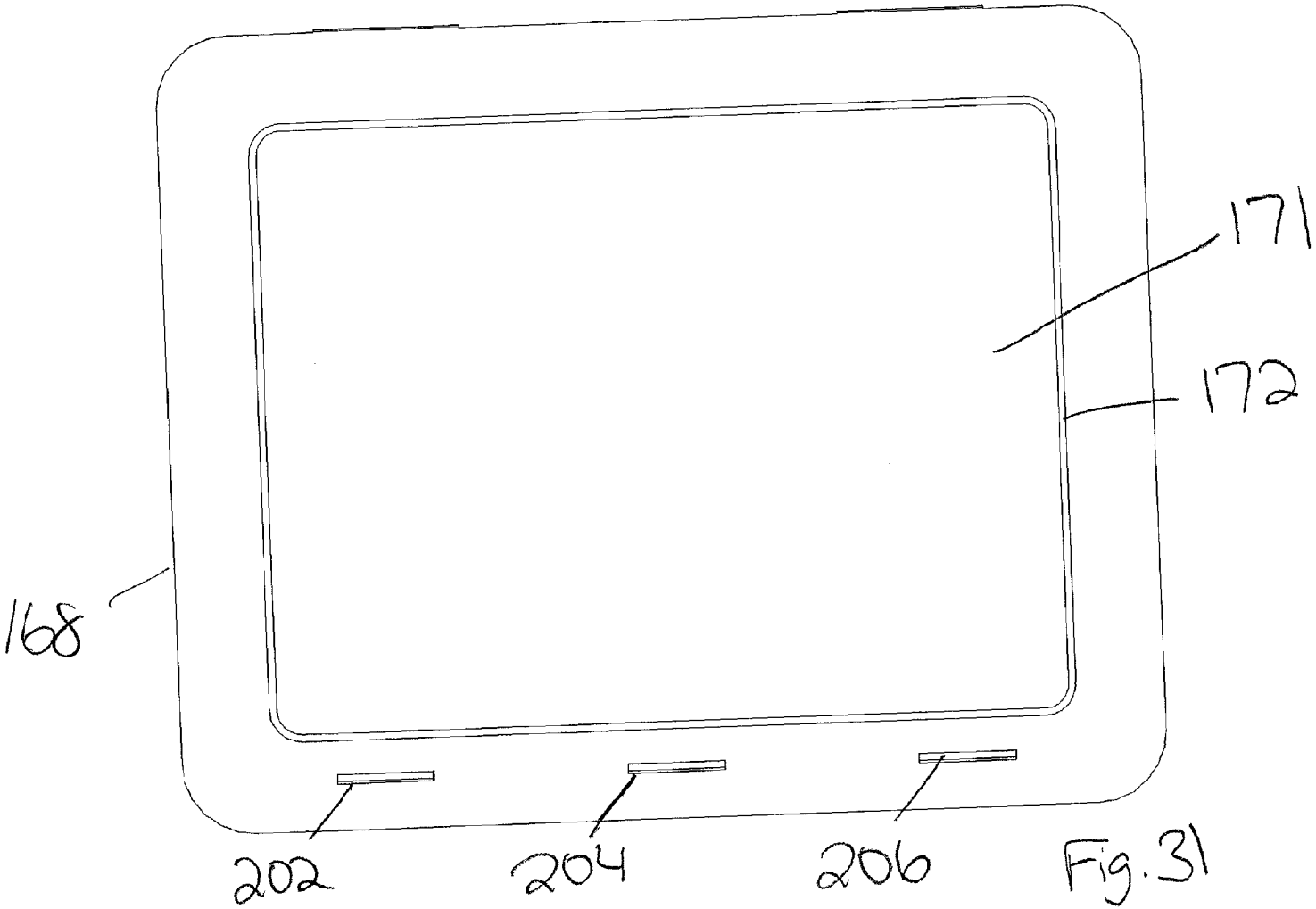
FIG. 31 is a top view thereof.

FIG. 31 provides additional details of the base 168. The shoulder 172 extends upwards from the base 168 towards the lid 166 when the lid 166 is in the closed position. The shoulder 172 extends above the top of the base 168. The base 171 forms an access aperture 171 to provide access to the contents of the packaging. The shoulder 172 is located adjacent the access aperture 171.

Retention fingers 202, 204, 206 located on base 168 match retention fingers 180, 182, 184 located on lid 166. The retention fingers contact each other to seal the packaging. The contact of the retention fingers will be discussed below.

Figure 32:
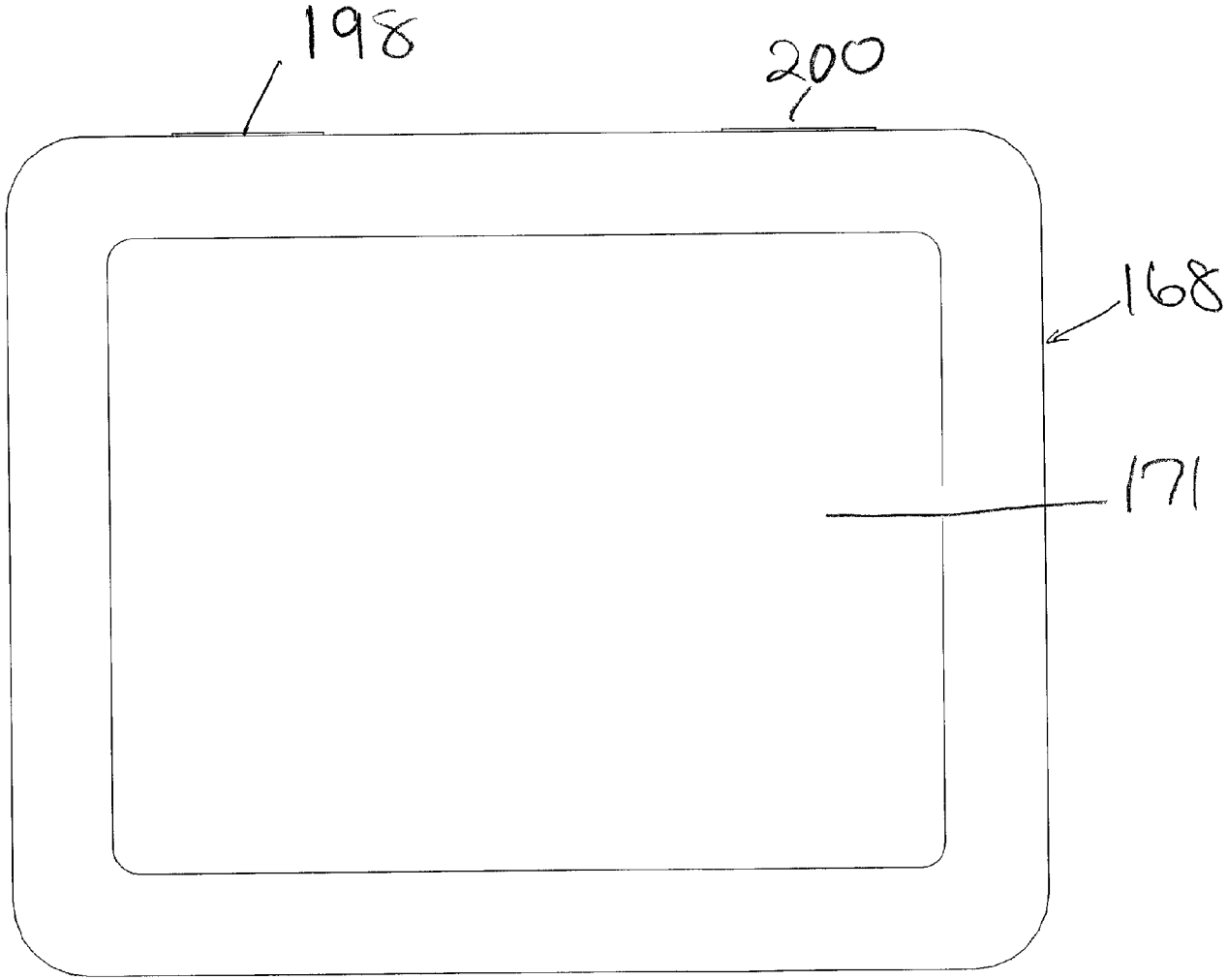
FIG. 32 is a bottom view thereof.

FIG. 32 shows the bottom of the base 168 that attaches to the packaging. The bottom of the base 168 may be attached to the packaging by adhesives. The base 168 may be attached to the packaging by other methods. The packaging may be melted onto the base 168 by a hot bar, impulse, ultrasonic, or other sealing device. In one embodiment, base 168 is attached to the packaging by an adhesive. A hot melt adhesive is sprayed via a heated gun onto the base 168. The base is then pressed onto the packaging while the glue is still hot. The base 168 may be attached to the packaging via other adhesives.

Figure 33:
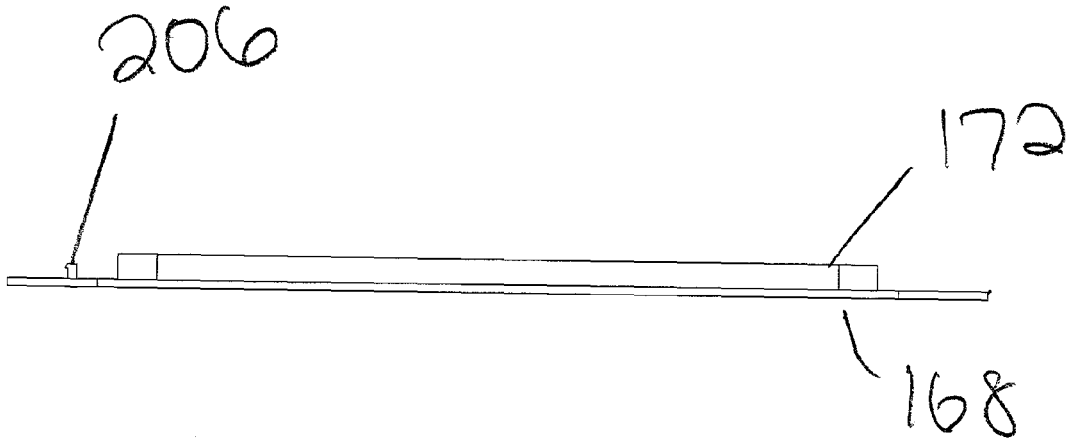
FIG. 33 is a right side view thereof; the left side view being a mirror image of the right side view.
Figure 34:
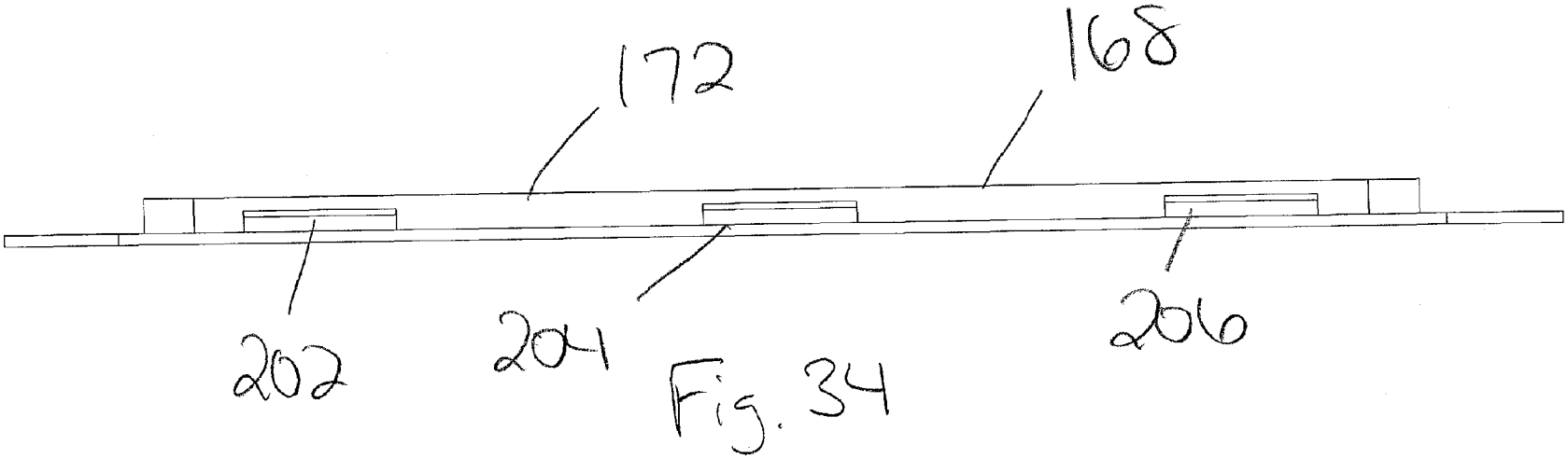
FIG. 34 is a front view thereof.

FIGS. 33 and 34 show a side view of the base providing additional information regarding the shoulder 172 and retention fingers 202, 204, 206. As discussed above, shoulder 172 extends upwards from base 168. Retention fingers 202, 204, 206 provide an extension that forms a hook for grasping the matching retention finger located on lid 166.

Figure 35:
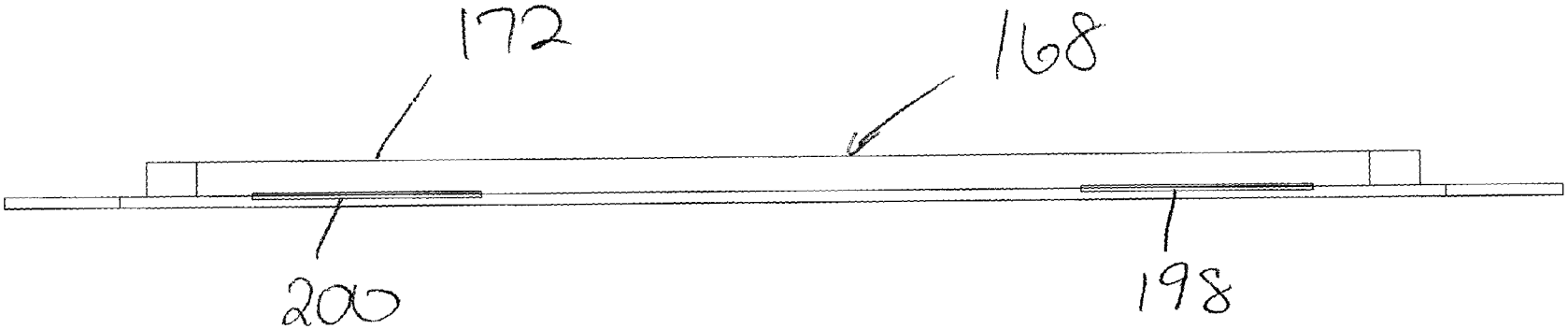
FIG. 35 is a rear view thereof.

FIG. 35 shows the hinges 198, 200 for attachment of the lid 166 to base 168.

Figure 36:
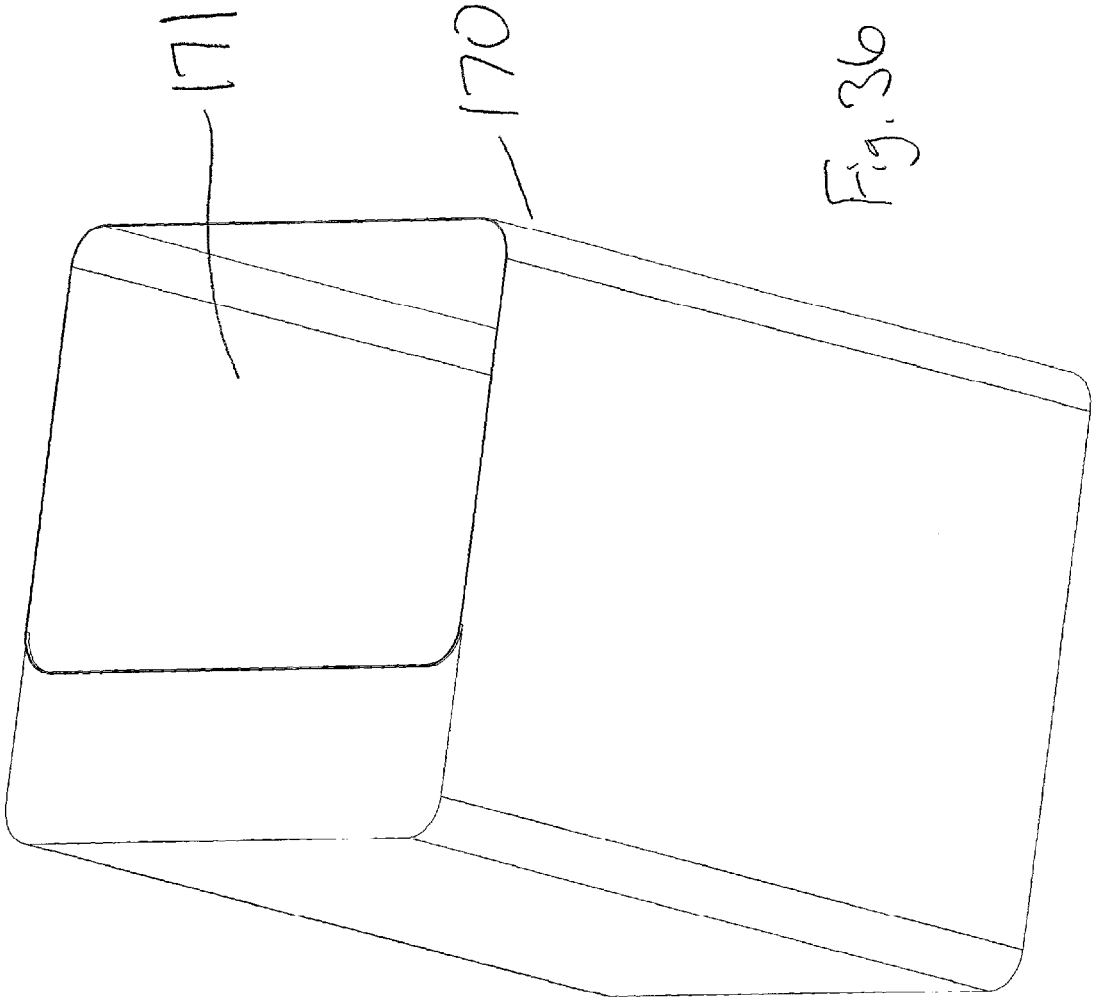
FIG. 36 is a perspective view of the packaging of one embodiment of the present invention.

FIG. 36 shows the packaging 171. As discussed above, the packaging 170 may be constructed from a flexible material. The bottom of base 168 attaches to the packaging 170. In one embodiment, the packaging 170 may have a preformed access aperture 171 for accessing the contents of the packaging 170. In another embodiment, the user may create an access aperture for accessing the contents of the packaging 170. The access aperture 171 of the base 168 aligns with the access aperture of packaging 170 to provide the user with access to the contents within the packaging 170.

Figure 37:
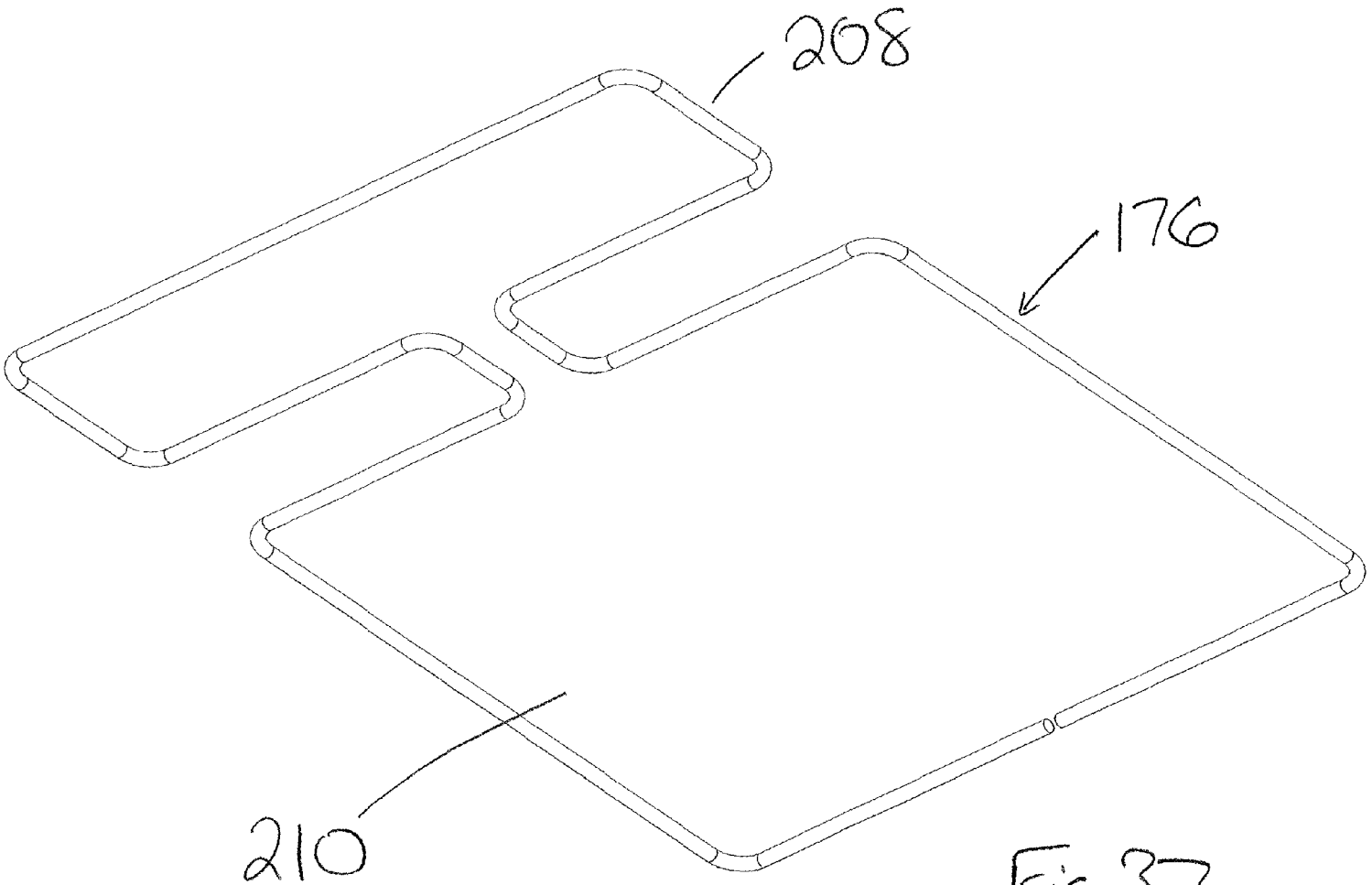
FIG. 37 is a perspective view of the scoop of one embodiment of the present invention.

FIG. 37 shows scoop 176. Handle 208 enables the user to grasp scoop 176. Scoop frame 210 provides an area for attachment of a scooping body. Scoop frame 210 of one embodiment provides a rigid frame constructed from plastic, wire, etc.

The scooping body of scoop 176 allows the user to handle the contents of the packaging. Scooping body attaches to scoop frame 210. Scooping body may be constructed from a gauze/mesh fabric, plastic film. The material of the scooping body allows scoop 176 to lay flat or essentially flat during storage of scoop 176. The material of the scooping body also limits damage to the lid and packaging when additional bags are stacked on each other. In one embodiment, the scooping body does not extend into handle 208. The scooping body of another embodiment extends into handle 208.

Figure 38:
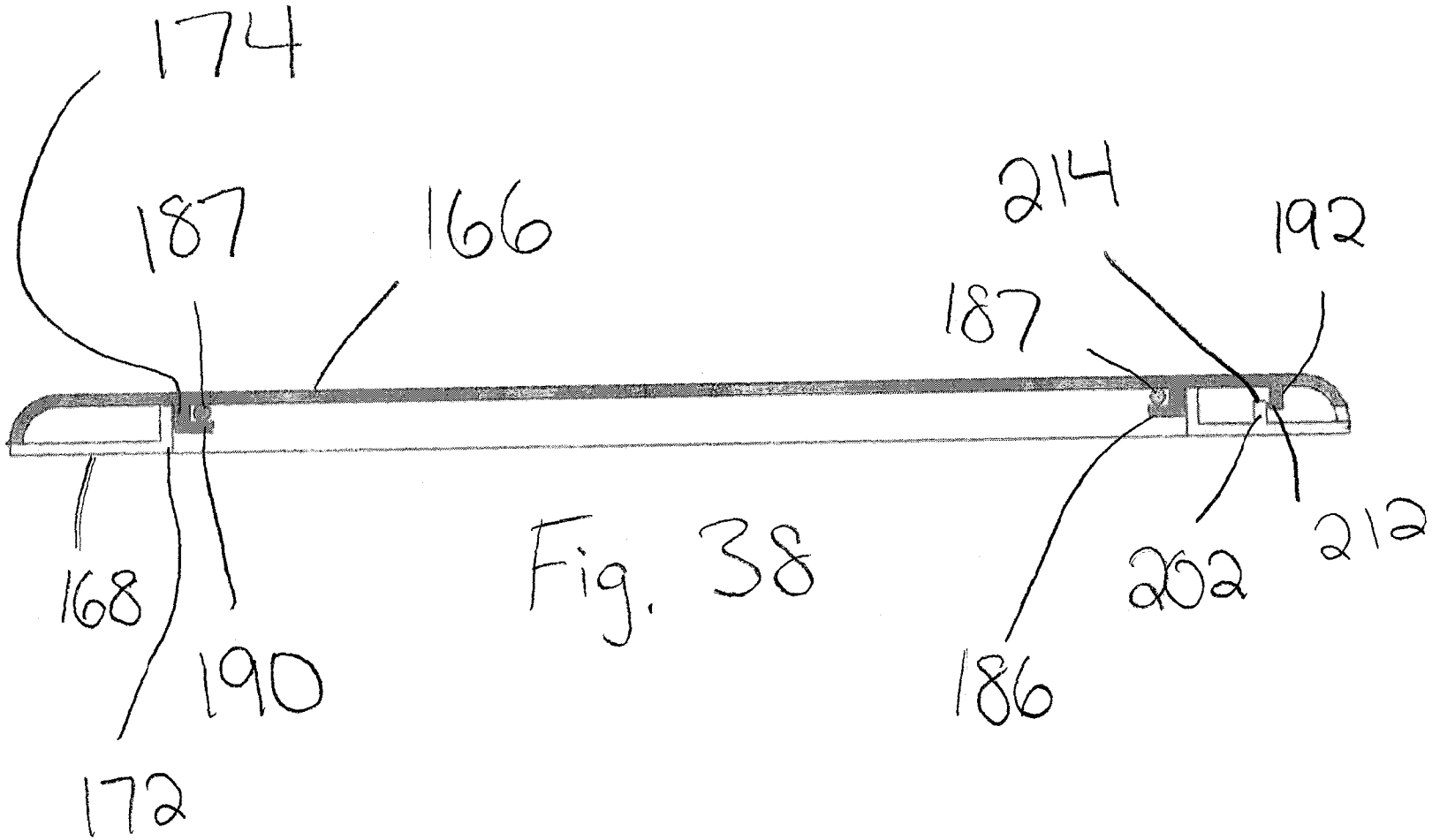
FIG. 38 is a cutaway view of one portion of one embodiment of the present invention.

FIG. 38 shows a view of the lid 166 adjusted to the closed position. The retention fingers 192, 194, 196 of lid 166 contacts the retention fingers 202, 204, 206 of the base 168. Each retention finger 192, 194, 196, 202, 204, 206 is located to allow for the contact. Extensions 212 of retention fingers 192, 194, 196 contact extensions 214 of retention fingers 202, 204, 206. The extensions 212, 214 extend outwards for latching to the other extension 212, 214.

One embodiment of the present invention uses a gasket 187 to assist with sealing the reclosure. Gasket 187 is located between fastening fingers 186, 188, 190 and lid 166. The gasket 187 may be constructed from rubber, plastic, silicone, or other material. Gasket 187 biases the fastening fingers 186, 188, 190 and neck 174 towards shoulder 172. The gasket 187 assists with sealing the access aperture to limit the contents from spilling from the packaging.

Fastening fingers 186, 190 extend downwards from lid 166 when lid 166 is adjusted to the closed position. The fastening fingers 186 form an L-shape in which the extension is directed horizontally away from neck 174. In one embodiment, the fastening fingers 186, 188, 190 extends farther downward from the lid 166 than the retention fingers 192, 194, 196. The fastening fingers 186, 188, 190 extend downward to be located proximate neck 174 when the lid 166 is adjusted to the closed position. In one embodiment, the fastening fingers 186, 188, 190 abut the neck 176.

The increased contact of fastening fingers 186, 188, 190 with neck 176 and the L-shaped design of fastening fingers 186, 190 assist with maintaining the contents within the packaging. Movement of the contents downward into the packaging by fastening fingers 186, 188, 190 help maintain the lid 166 in the closed position. The fastening fingers 186, 190 keep the contents within the packaging and help secure the lid 166 in the closed position. The fastening fingers 186, 190 assist with securing the retention fingers 192, 194, 196 with retention fingers 202, 204, 206.

Figure 39:
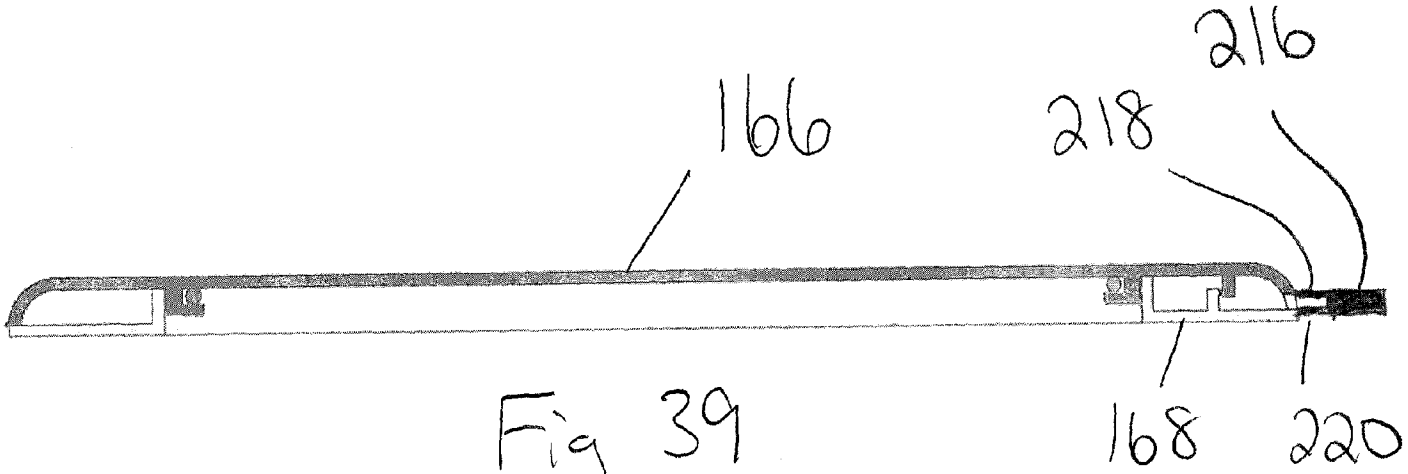
FIG. 39 is a cutaway view of one portion of one embodiment of the present invention.
Figure 40:
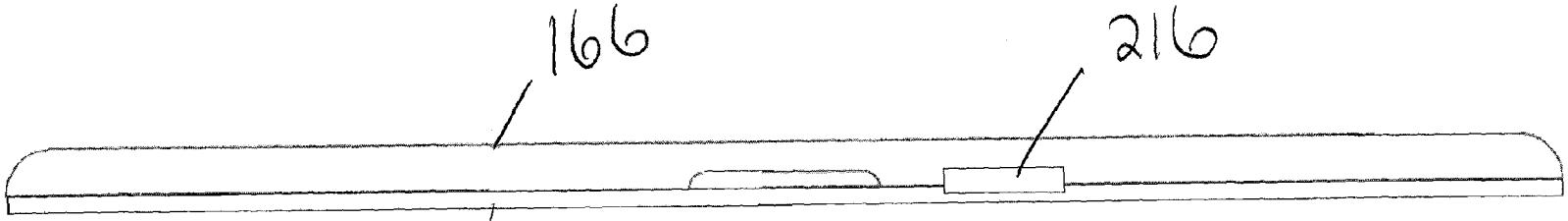
FIG. 40 is a front view thereof.
Figure 41:
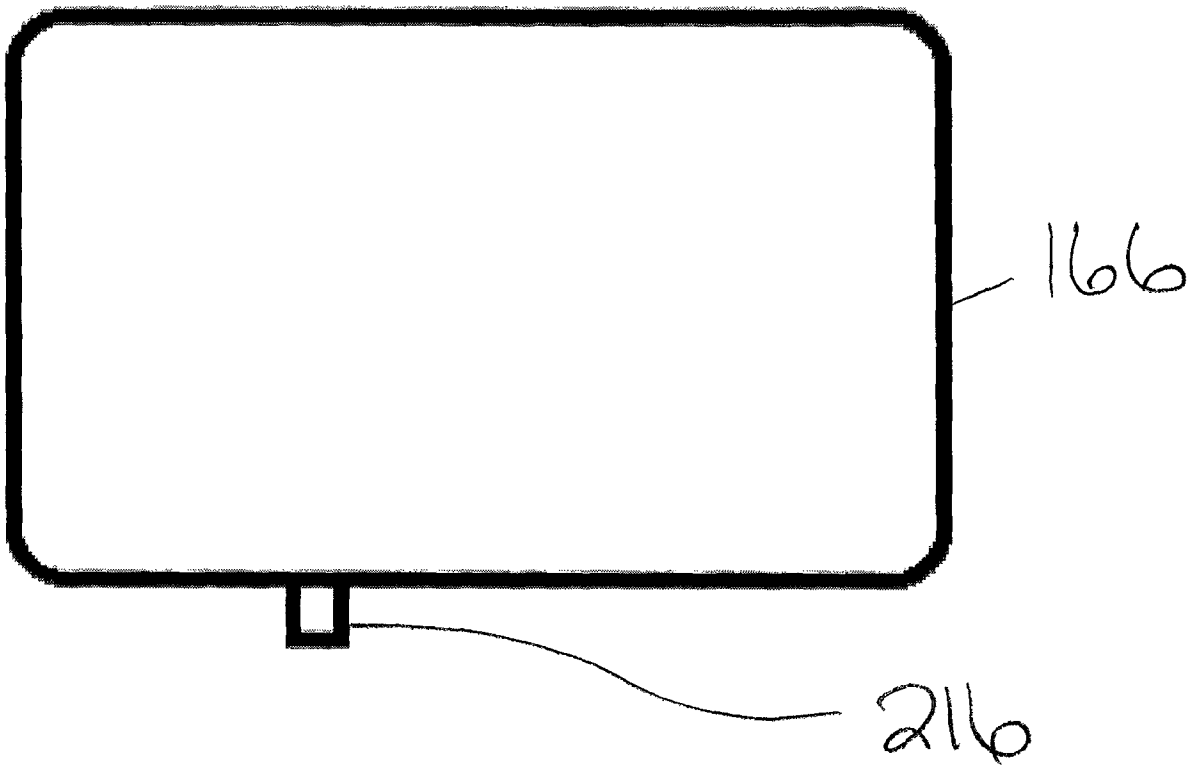
FIG. 41 is a top view thereof.
Figure 44:
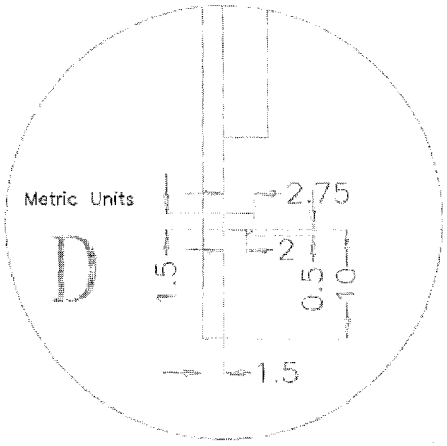
FIG. 44 is a side view of one portion of one embodiment of the present invention.
Figure 45:
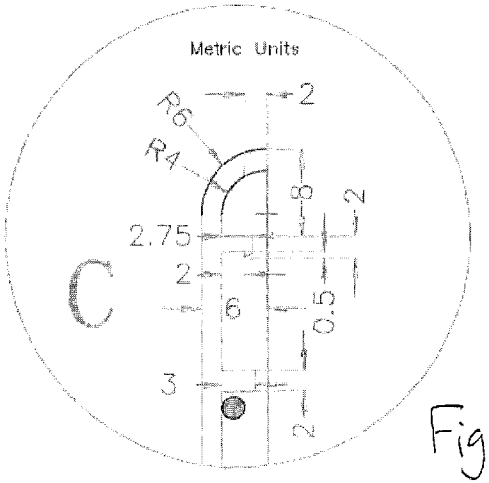
FIG. 45 is a side view of one portion of one embodiment of the present invention.
Figure 43:
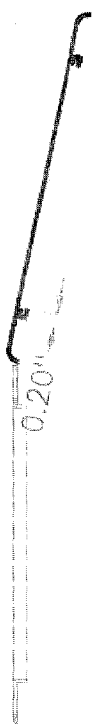
FIG. 43 is a left side view of one portion of one embodiment of the present invention, the right side view being a mirror image of the left side view.
Figure 42:
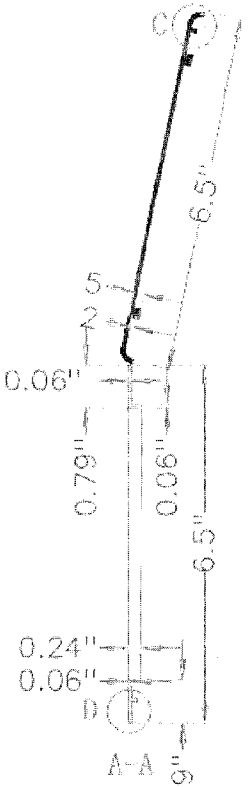
FIG. 42 is a left side view of one portion of one embodiment of the present invention, the right side view being a mirror image of the left side view.

FIGS. 39-41 show another embodiment with a security body 216 that indicates that the lid 166 has not been opened. Security body 216 attaches to both the lid 166 and the base 168. Security finger 218 attaches to lid 166. Security finger 220 attaches to base 168. The security fingers 218, 220 are attached with a breakaway connection that allows the security fingers 218, 220 to be removed from lid 166 and base 168. The user may open the lid 166 by removing security body 216 from the lid 166 and the base 168.

Once removed, the security body 216 of one embodiment does not simply reattach to the lid 166 and the base 168. A detached security body 216 warns the user that the lid 166 may have been opened and that the contents of the packaging may have been tampered with. Therefore, the user may treat the contents of the packaging appropriately knowing that the contents may have been tampered with.

FIGS. 42-45 show one embodiment of the lid and base of the present invention and the measurements associated with the lid, the base, the retention fingers, and the fastening fingers. In this embodiment, the distance that the retention fingers and fastening fingers extend from lid is equal or approximately equal.

FIGS. 46-50 show another embodiment of the lid and base showing a different design. FIGS. 46-50 also show the different dimensions of the lid and base.

FIGS. 51-56 show another embodiment of the lid and base showing a different design. FIGS. 51-56 also show the different dimensions of the lid and base.

Figure 58:
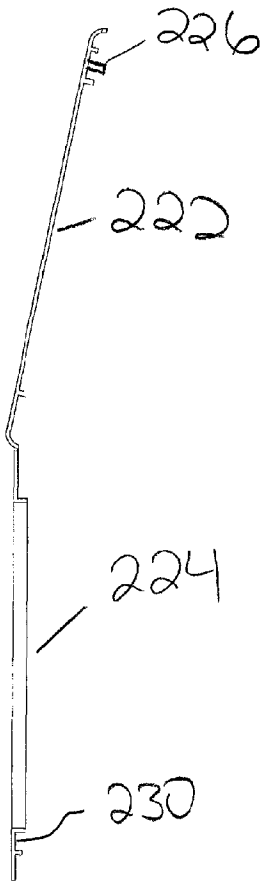
FIG. 58 is a left side view thereof.
Figure 57:
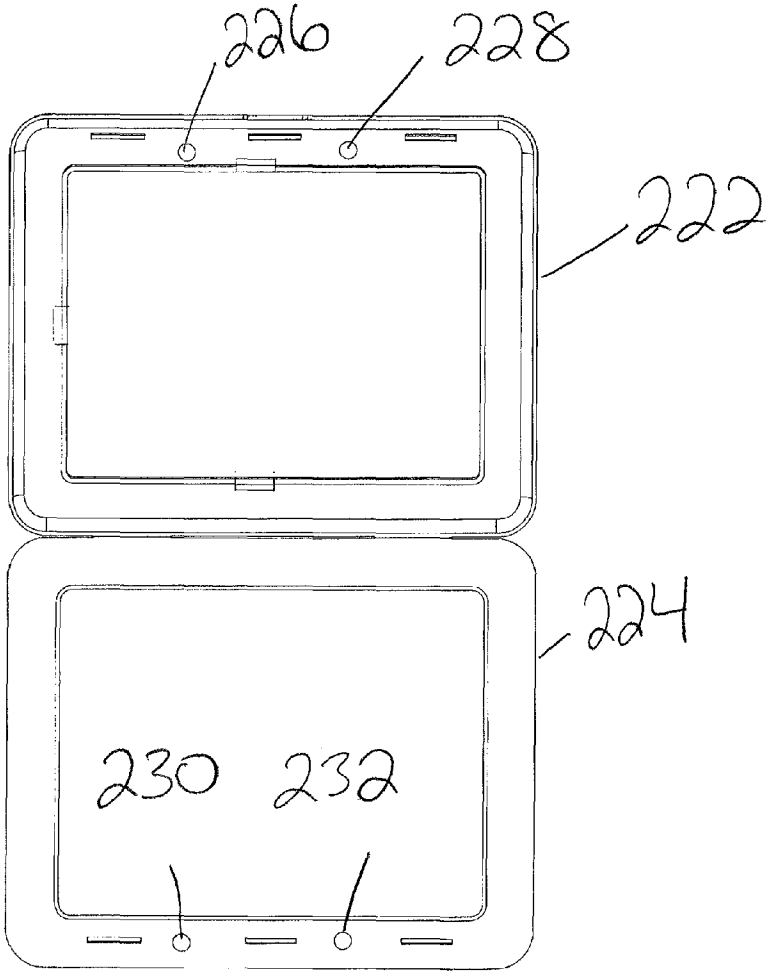
FIG. 57 is a top view of one embodiment of the present invention.

FIGS. 57 and 58 show another embodiment of the present invention that uses dowels 226, 228 to assist aligning lid 222 with base 224. Dowels 226, 228 extend from the lid 222. When the lid 222 is adjusted to the closed position, the dowels 226, 228 extend downward from the lid to be inserted into dowel receivers 230, 232. Dowel receivers 230, 232 provide apertures within base 224 for insertion of the dowels 230, 232 within the receivers. The dowels 226, 228 align the lid 222 with base 224 for closure of the base lid 222. The dowels 226, 228 assist with sealing the access aperture by aligning the base 224 with lid 222 such that the neck will abut the shoulder to help seal the packaging.

Therefore the present invention provides rigid re-closure applied to a flexible packaging bag that allows access into the bag and provides a means of reclosing the bag to prevent product leaking back out. The sealing head may or may not be child resistant. The reclosure body may be affixed to the bag via adhesive or heat sealed onto the plastic bag. A scoop may be part of the sealing head or may be simply placed inside the bag. The reclosure body of the present invention may be applied to a Gambo bag, Smartcube bag, layflat bag, standup pouch, U-pack or any other flexible packaging bag used to package both liquid and solid products. The sealing head of the present invention may also be snapped into place and may or may not be hinged at the back of the sealing head.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a shoulder extending from the top of the base, the shoulder extending away from the flexible packaging the shoulder is located adjacent the access aperture;

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a first fastening finger of the lid extending downwards from the underside of the lid;

a neck extending from the underside of the lid wherein the neck is sized to pass into the access aperture when the lid is adjusted to the closed position;

a first fastening finger located on the base; the first fastening finger extending upwards from the top of the base, the first fastening finger of the base contacting the first fastening finger of the lid when the lid is adjusted to the closed position to maintain the lid in the closed position; and at least one hinge wherein the hinge secures the lid to the base enabling the lid to pivot between the open position and the closed position; and a scoop including two scoop fingers that extend outwards from scoop to engage the two attachment lips.

2. The device of claim 1 further comprising:

a sealing finger extending approximately perpendicular from the neck, the sealing finger configured to pass into the access aperture when the lid is in the closed position wherein the sealing finger biases the neck towards the shoulder.

3. The device of claim 2 further comprising:

a gasket located between the sealing finger and the lid.

4. The device of claim 1 further comprising:

an access tab of the lid wherein the access tab extends outward above the base such that the access tab extends beyond the location that the lid and base meet when the lid is adjusted to the closed position.

5. The device of claim 1 further comprising:

an access tab of the lid wherein the access tab stops at or before the location that the lid and the base meet when the lid is adjusted to the closed position;

an adjustment aperture located between the lid and the base that provides separation between the lid and the base for adjusting the lid from the closed position to the open position.

6. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a shoulder extending from the top of the base, the shoulder extending away from the flexible packaging, the shoulder is located adjacent the access aperture;

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a neck extending from the underside of the lid wherein the neck is sized to pass into the access aperture when the lid is adjusted to the closed position;

a scoop including two scoop fingers that extend outwards from scoop to engage the two attachment lips; and a first fastening finger of the lid extending downwards from the underside of the lid;

a first fastening finger located on the base; the first fastening finger extending upwards from the top of the base, the first fastening finger of the base contacting the first fastening finger of the lid when the lid is adjusted to the closed position to maintain the lid in the closed position.

7. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a shoulder extending from the top of the base, the shoulder extending away from the flexible packaging, the shoulder is located adjacent the access aperture;

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a neck extending from the underside of the lid wherein the neck is sized to pass into the access aperture when the lid is adjusted to the closed position;

a scoop including two scoop fingers that extend outwards from scoop to engage the two attachment lips; and a sealing finger extending approximately perpendicular from the neck, the sealing finger configured to pass into the access aperture when the lid is in the closed position wherein the sealing finger biases the neck towards the shoulder.

8. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a shoulder extending from the top of the base, the shoulder extending away from the flexible packaging, the shoulder is located adjacent the access aperture:

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a neck extending from the underside of the lid wherein the neck is sized to pass into the access aperture when the lid is adjusted to the closed position;

a scoop including two scoop fingers that extend outwards from scoop to engage the two attachment lips; and a gasket located between the sealing finger and the lid.

9. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a neck extending from the underside of the lid wherein the neck is sized to pass into the access aperture when the lid is adjusted to the closed position;

a shoulder extending from the top of the base, the shoulder extending away from the flexible packaging wherein the shoulder is located adjacent the access aperture, wherein the neck is located between the access aperture and the shoulder when the lid is adjusted to the closed position; and a scoop including two scoop fingers that extend outwards from scoop to engage the two attachment lips; and a first fastening finger of the lid extending downwards from the underside of the lid;

a first fastening finger located on the base; the first fastening finger extending upwards from the top of the base, the first fastening finger of the base contacting the first fastening finger of the lid when the lid is adjusted to the closed position to maintain the lid in the closed position.

10. A rigid reclosure device installed on flexible packaging for sealing the flexible packaging to maintain contents inside the flexible packaging, the rigid reclosure device comprising:

a base, the bottom of the base attached to the flexible packaging;

an access aperture providing access through the base;

a lid attachable to the base, the lid configured to adjust to an open position and a closed position, the lid limiting access to the access aperture when the lid is in the closed position wherein the lid contacts the base to secure the lid in the closed position, the lid defining two attachment lips;

a neck extending from the underside of the lid wherein the neck is sized to pass into the access aperture when the lid is adjusted to the closed position;

a shoulder extending from the top of the base, the shoulder extending away from the flexible packaging wherein the shoulder is located adjacent the access aperture, wherein the neck is located between the access aperture and the shoulder when the lid is adjusted to the closed position;

a scoop including two scoop fingers that extend outwards from scoop to engage the two attachment lips; and a sealing finger extending approximately perpendicular from the neck, the sealing finger configured to pass into the access aperture when the lid is in the closed position wherein the sealing finger biases the neck towards the shoulder; and a gasket located between the sealing finger and the lid.

* * * * *